United States Patent [19]

Sato et al.

[11] Patent Number: 4,975,361

[45] Date of Patent: Dec. 4, 1990

[54] COLOR PHOTOGRAPHIC LIGHT-SENSITIVE MATERIAL

[75] Inventors: Kozo Sato; Hiroshi Hara, both of Kanagawa, Japan

[73] Assignee: Fuji Photo Film Co., Ltd., Kanagawa, Japan

[21] Appl. No.: 287,303

[22] Filed: Dec. 21, 1988

[30] Foreign Application Priority Data

Dec. 22, 1987 [JP] Japan ..... 62-324576

[51] Int. Cl.[5] ..... G03C 5/54; G03C 7/26

[52] U.S. Cl. ..... 430/559; 430/222; 430/223; 430/226

[58] Field of Search ..... 430/223, 224, 559, 226, 430/222

[56] References Cited

U.S. PATENT DOCUMENTS 3,854,945 12/1974 Bush et al. ..... 430/224
3,880,658 4/1975 Lestina et al. ..... 430/223
4,606,991 8/1986 Kawata et al. ..... 430/223
4,783,396 11/1988 Nakamura et al. ..... 430/223

FOREIGN PATENT DOCUMENTS 1478995 6/1974 United Kingdom .

*Primary Examiner*—Richard L. Schilling
*Attorney, Agent, or Firm*—Sughrue, Mion, Zinn, Macpeak & Seas

[57] ABSTRACT

A color photographic light-sensitive material comprising a support having thereon at least one layer containing light-sensitive silver salt, wherein the color photographic a light-sensitive material contains at least one image forming compound represented by the following general formula (I):

$$(\text{Dye-X})_q\text{-Y} \qquad \text{(I)}$$

wherein Dye, X, q and Y are described in detail below.

8 Claims, 2 Drawing Sheets

COLOR PHOTOGRAPHIC LIGHT-SENSITIVE MATERIAL

FIELD OF THE INVENTION

The present invention relates to a novel magenta dye image forming compound and a color photographic light-sensitive material containing such a compound.

BACKGROUND OF THE INVENTION

Color diffusion transfer processes using dye releasing redox compounds which can release a diffusible magenta dye as a result of development under basic conditions are well known.

As dye releasing redox compounds which release a magenta dye, those described, for example, in JP-A-49-114424, JP-A-50-115528, JP-A-55-4028, JP-A-61-273542 (the term "JP-A" as used herein refers to a "published unexamined Japanese patent application"), U.S. Pat. Nos. 3,932,380 and 3,931,144, are known.

However, the compounds as described in these patents contain an azo series dye moiety having a relatively high hydrophobicity and dyes released therefrom have low diffusibility and insufficient spectral characteristic for color reproducibility. From a standpoint of color reproducibility, it has been particularly desired to reduce the subsidiary absorption of dye in a blue light region.

SUMMARY OF THE INVENTION

Therefore, an object of the present invention is to provide a color photographic light-sensitive material containing a dye releasing redox compound which release a diffusible magenta dye having excellent spectral characteristics.

Another object of the present invention is to provide a color photographic light-sensitive material containing a magenta dye releasing redox compound which has good diffusibility and gives high transfer density in a short period of processing time.

Other objects of the present invention will become apparent from the following detailed description and examples.

The above-described objects of the present invention are attained with a color photographic light-sensitive material comprising a support having thereon at least one light-sensitive silver salt containing layer, wherein the color photographic light-sensitive material contains at least one image forming compound represented by the following general formula (I):

$$(\text{Dye-X})_q\text{—Y} \qquad \text{(I)}$$

wherein Dye represents a magenta dye moiety or a precursor moiety thereof represented by the general formula (II) described below; X represents a simple bond or a connecting group; Y represents a group which has a property of cleaving the X-Y bond upon a development reaction in correspondence or counter-correspondence to light-sensitive silver salts having a latent image distributed imagewise; and q represents 1 or 2. When q represents 2, two Dye-X's may be the same or different.

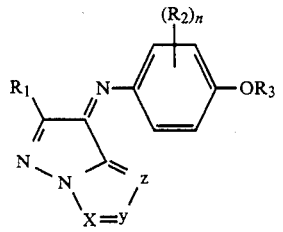

(II)

wherein $R_1$ and $R_2$ each represents a hydrogen atom, a halogen atom, an alkyl group, a cycloalkyl group, an aralkyl group, an alkenyl group, an aryl group, an alkoxy group, an aryloxy group, a cyano group, an acylamino group, a sulfonamino group, a ureido group, an alkylthio group, an arylthio group, an alkoxycarbonyl group, a carbamoyl group, a sulfamoyl group, a sulfonyl group, an acyl group, a urethane group, an amino group, a hydroxy group, a carboxy group, a sulfamoylamino group or a heterocyclic group; n represents an integer from 0 to 3, provided that when n represents 2 or 3, two or three $R_2$'s may be the same or different, or two R2's may combine with each other to form a saturated or unsaturated ring; x, y and z each represents

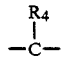

or a nitrogen atom, and when both x and y or both y and z represent

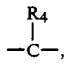

they may combine with each other to form a saturated or unsaturated ring; $R_4$ represents a hydrogen atom, an alkyl group, a cycloalkyl group, an aralkyl group, an aryl group, an alkoxy group, an aryloxy group, an amino group, an acylamino group or a sulfonylamino group; $R_3$ represents a hydrogen atom, a monovalent cation or a hydrolyzable group; Dye is connected to X at $R_1$, $R_2$, $R_3$, x, y or z in the general formula (II); and the above-described substituents may be further substituted with other substituent(s).

Examples of such substituent(s) include an alkyl group, a halogen atom, an aralkyl group, an aryl group, an alkoxy group, an aryloxy group, a cyano group, a nitro group, a carboxyl group, a sulfo group, a hydroxyl group, an acylamino group, a sulfonylamino group, a carbamoyl group, a sulfamoyl group, an acyl group, a sulfonyl group and an amino group.

BRIEF DESCRIPTION OF THE DRAWINGS

FIG. 1 shows the visible absorption spectrum of Compound (1) according to the present invention. In FIG. 2, (1), (x) and (y) denote absorption spectral distributions of Compound (1) according to the present invention, Comparative Compound (x) and Comparative Compound (y), respectively.

DETAILED DESCRIPTION OF THE INVENTION

Figure 1:
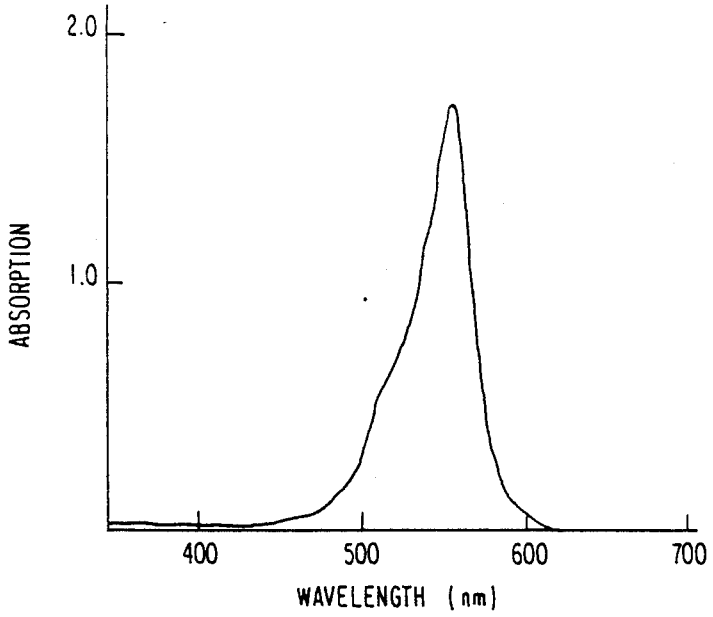
FIG. 1 and FIG. 2 are graphs showing an absorption spectral distribution of a magenta dye.

The magenta dye image forming compound represented by the general formulae (I) and (II) are described in detail below.

$R_1$ and $R_2$ each represents a hydrogen atom, a halogen atom (for example, chlorine and bromine), an alkyl group (preferably having from 1 to 8 carbon atoms, for example, methyl, ethyl, isopropyl, hydroxyethyl, methoxyethyl, cyanoethyl, and trifluoroethyl), a cycloalkyl group (for example, cyclopentyl and cyclohexyl), an aralkyl group (for example, benzyl and 2-phenethyl), an alkenyl group (for example, vinyl, allyl and crotyl), an aryl group (for example, phenyl, p-tolyl, p-methoxyphenyl and o-methoxyphenyl), an alkoxy group (preferably having from 1 to 8 carbon atoms, for example, methoxy, ethoxy, isopropoxy, 2-methoxyethoxy and 2-hydroxyethoxy), an aryloxy group (for example, phenoxy, p-methylphenoxy and o-carboxyphenoxy), a cyano group, an acylamino group (for example, acetylamino, propionylamino and o-carboxybenzoylamino), a sulfonylamino group (for example, methanesulfonylamino, benzenesulfonylamino and p-methoxybenzenesulfonylamino), a ureido group (for example, 3-methylureido and 3,3-dimethylureido), an alkylthio group (for example, methylthio and ethylthio), an arylthio group (for example, phenylthio and o-carboxyphenylthio), an alkoxycarbonyl group (for example, methoxycarbonyl and ethoxycarbonyl), a carbamoyl group (for example, methylcarbamoyl and dimethylcarbamoyl), a sulfamoyl group (for example, methylsulfamoyl and dimethylsulfamoyl), a sulfonyl group (for example, methanesulfonyl, ethanesulfonyl and 2-methoxyethylsulfonyl), an acyl group (for example, acetyl, propionyl, cyanoethyl and acetoacetyl), a urethane group (for example, methylurethane and ethylurethane), an amino group (for example, amino, methylamino, diethylamino, carboxymethylamino, o-carboxyanilino and p-hydroxyanilino), a hydroxy group, a carboxy group, a sulfamoylamino group (for example, sulfamoylamino and 3,3-dimethylsulfamoylamino), or a heterocyclic group (for example, $\alpha$-pyridyl, $\tau$-pyridyl and 2-furyl). Among these substituents, an alkyl group having up to 6 carbon atoms, an alkoxy group having up to 6 carbon atoms, a chlorine atom, an acylamino group having up to 7 carbon atoms, a sulfonylamino group having up to 7 carbon atoms, an aryloxy group having up to 8 carbon atoms, a hydroxy group, a carboxy group, a carbamoyl group having up to 7 carbon atoms and a sulfamoyl group having up to 7 carbon atoms are particularly preferred.

$R_3$ represents a hydrogen atom, a monovalent cation (for example, $Na^+$, $K^+$, $NH_4^+$, and $N(CH_3)_4^+$) or a hydrolyzable group (for example, acyl, sulfonyl and dialkylphosphoryl). Among them, a hydrogen atom is preferred.

x, y and z each represents $$-\overset{R_4}{\overset{|}{C}}-$$

or a nitrogen atom, and R4 represents a hydrogen atom, an alkyl group, a cycloalkyl group, an aralkyl group, an aryl group, an alkoxy group, an aryloxy group, an amino group, an acylamino group or a sulfonylamino group. Suitable examples of these substituents are those described for $R_1$ and $R_2$.

Preferred examples of x, y and z include the case wherein each of x, y and z represents a nitrogen atom, the case wherein two of x, y and z represent nitrogen atoms and the case wherein one of x, y and z represents a nitrogen atom. Among them, the case wherein all of x, y and z are nitrogen atoms and the case wherein two of x, y and z are nitrogen atoms are particularly preferred.

Taking a method of connecting Dye to the substrate represented by Y as an image forming dye into consideration, dye moieties wherein two of x, y and z are nitrogen atoms are excellent in view of preparation aptitude. Of the dye moieties wherein two of x, y and z are nitrogen atoms, pyrazolo[1,5-b][1,2,4]triazole derivatives represented by the general formula (III) described below are particularly suitable for the present invention, since dyes containing such moieties have low pKa, excellent mordanting property and provide good image stability.

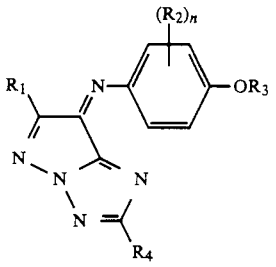

(III)

wherein $R_1$, $R_2$, $R_3$, $R_4$ and n each has the same meaning as defined in the general formula (II).

Synthesis methods of the pyrazolo[1,5-b][1,2,4]-triazole derivatives are described in detail in JP-A-60-186567.

The dyes according to the present invention provide magenta hue by the formation of an anion due to dissociation of the OH group, and thus are essentially distinct from indoaniline dyes described in JP-A-60-186567.

X may be connected to any position of Dye. Representative examples of the connecting group represented by X include a group represented by $$-\overset{R_5}{\overset{|}{N}}-$$

(wherein $R_5$ represents a hydrogen atom, an alkyl group, or a substituted alkyl group), $-SO_2-$, $-CO-$, an alkylene group, a substituted alkylene group, a phenylene group, a substituted phenylene group, a naphthylene group, a substituted naphthylene group, —O—, —SO—, or a group derived from the combination of two or more of the foregoing divalent groups. Among them, $$-\overset{R_5}{\overset{|}{N}}-SO_2-, \quad -\overset{R_5}{\overset{|}{N}}-CO-$$

and $-R_6-(L)_k-(R_7)_l-$ are preferred, wherein $R_5$ has the same meaning as defined above, $R_6$ and $R_7$ each represents an alkylene group, a substituted alkylene group, a phenylene group, a substituted phenylene group, a naphthylene group, or a substituted naphthylene group; L represents —O—, —CO—, —SO—, —$SO_2$—, —$SO_2NH$—, —$NHSO_2$—, —CONH—or —NHCO—; k represents 0 or 1; and l represents 1 when k is 1, or 0 or 1 when k is 0.

Further, combinations of

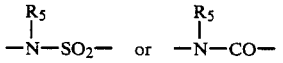

with —$R_6$—$(L)_k$—$(R_7)_l$—are also preferred.

The groups represented by $R_4$, $R_5$, $R_6$ and $R_7$ preferably have from 1 to 8 carbon atoms.

Among the connecting groups between the Dye portion and the Y portion, the structure represented by Dye-$SO_2NH$-Y is particularly preferred.

Preferred embodiments of Y in the general formula (I) are now described in greater detail.

In one embodiment, Y is selected so that the compound represented by the general formula (I) is a non-diffusible image forming compound which is oxidized as a result of development, thereby undergoing self-cleavage and releasing a diffusible dye.

An example of Y which is effective for compounds of this type is an N-substituted sulfamoyl group. For example, a group represented by the following general formula (YI) is illustrated for Y.

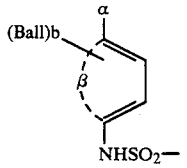

(YI)

wherein $\beta$ represents a nonmetallic atomic group necessary for forming a benzene ring, which may optionally be fused with a carbon ring or a hetero ring to form, for example, a naphthalene ring, a quinoline ring, a 5,6,7,8-tetrahydronaphthalene ring, or a chroman ring; represents a group of —$OG^{11}$ or —$NHG_{12}$ (wherein $G^{11}$ represents a hydrogen atom or a group which forms a hydroxyl group upon being hydrolyzed, and $G^{12}$ represents a hydrogen atom, an alkyl group containing from 1 to 22 carbon atoms or a hydrolyzable group); Ball represents a ballast group; and b represents an integer of 0, 1 or 2.

Specific examples of this type of Y are described in JP-A-48-33826 and JP-A-53-50736.

Other examples of Y suited for this type of compound are those represented by the following general formula (YII):

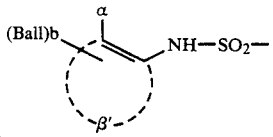

(YII)

wherein Ball, $\alpha$ and b each has the same meaning as defined in the general formula (YI), $\beta'$ represents an atomic group necessary for forming a carbon ring such as, for example, a benzene ring which may be fused with another carbon ring or a hetero ring to form a naphthalene ring, a quinoline ring, a 5,6,7,8-tetrahydronaphthalene ring, or a chroman ring. Specific examples of this type of Y are described in JP-A-51-113624, JP-A-56-12642, JP-A-56-16130, JP-A-56-16131, JP-A-57-4043, JP-A-57-650, and U.S. Pat. Nos. 4,053,312, 4,500,626 and 4,439,513.

Further examples of Y suited for this type of compound are those represented by the following general formula (YIII):

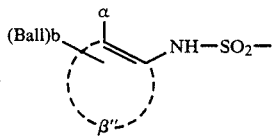

(YIII)

wherein Ball, $\alpha$ and b each has the same meaning as defined in the general formula (YI), and $\beta''$ represents an atomic group necessary for forming a hetero ring, for example, a pyrazole ring or a pyridine ring, the hetero ring being optionally fused with a carbon ring or a hetero ring. Specific examples of this type of Y are described in JP-A-51-104343.

Still further examples of Y suited for this type of compound are those represented by the following general formula (YIV):

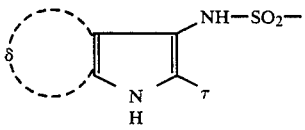

(YIV)

wherein $\tau$ preferably represents a hydrogen atom, a substituted or unsubstituted alkyl, aryl or heterocyclic group, or —CO—$G^{21}$; $G^{21}$ represents —$OG^{22}$, —$SG^{22}$ or

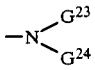

(wherein $G^{22}$ represents a hydrogen atom, an alkyl group, a cycloalkyl group or an aryl group, $G^{23}$ is the same as defined for $G^{22}$ above, or $G^{23}$ represents an acyl group derived from an aliphatic or aromatic carboxylic or sulfonic acid, and $G^{24}$ represents a hydrogen atom or an unsubstituted or substituted alkyl group); and $\delta$ represents a residue necessary for completing a fused benzene ring.

Specific examples of this type of Y are described in JP-A-51-104343, JP-A-53-46730, JP-A-54-130122 and JP-A-57-85055.

Still further examples of Y suited for this type of compound are those represented by the following general formula (YV):

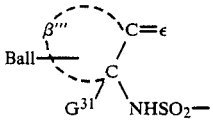

(YV)

wherein Ball has the same meaning as defined in the general formula (YI); $\epsilon$ represents an oxygen atom or $=NG^{32}$ (wherein $G^{32}$ represents a hydroxyl group or an optionally substituted amino group; examples of $H_2N$—$G^{32}$ to be used for forming the $=NG^{32}$ group include hydroxylamine, hydrazines, semicarbazides, and thiosemicarbazides); $\beta'''$ represents an atomic group necessary for forming a saturated or unsaturated non-aromatic 5-membered, 6-membered or 7-membered hydrocarbon ring; and $G^{31}$ represents a hydrogen atom or a halogen atom (for example, fluorine, chlorine or bromine).

Specific examples of this type of Y are described in JP-A-53-3819 and JP-A-54-48534.

Other examples of Y of this type of compound are described, for example, in JP-B-48-32129 (the term "JP-B" as used herein refers to an "examined Japanese patent publication"), JP-B-48-39165, JP-A-49-64436 and U.S. Pat. No. 3,443,934.

Still further examples of Y are those represented by the following general formula (YVI):

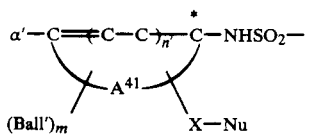

(YVI)

wherein α' represents $OR^{41}$ or $NHR^{42}$; $R^{41}$ represents a hydrogen atom or a hydrolyzable component; represents a hydrogen atom, an alkyl group containing from 1 to 50 carbon atoms or a hydrolyzable group; $A^{41}$ represents any atomic group necessary for forming an aromatic ring; Ball, represents an organic immobilizing group present on the aromatic ring; m represents an integer of 1 or 2, when m is 2, Ball's may be the same or different; X represents a divalent organic group having from 1 to 8 carbon atoms, with the nucleophilic group (Nu) and an electrophilic center (asterisked carbon atom) formed by oxidation forming a 5-membered to 12-membered ring; Nu represents a nucleophilic group; and n, represents an integer of 1 or 2. Specific examples of this type of Y are described in JP-A-57-20735.

As still further types of compounds represented by the general formula (I), there are nondiffusible image forming compounds which release a diffusible dye in the presence of a base as a result of self cyclization or the like but which, when reacted with an oxidation product of a developing agent, substantially never release the dye.

Examples of Y effective for this type of compound are those which are represented by the following general formula (YVII):

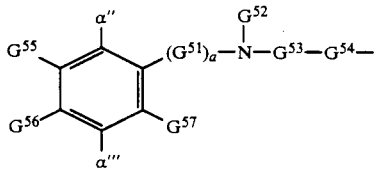

(YVII)

wherein α'' represents an oxidizable nucleophilic group (for example, a hydroxy group, a primary or secondary amino group, a hydroxyamino group, or a sulfonamido group) or a precursor thereof; α''' represents a dialkylamino group or an optional group defined for α'; $G^{51}$ represents an alkylene group having from 1 to 3 carbon atoms; a represents 0 or 1; $G^{52}$ represents a substituted or unsubstituted alkyl group having from 1 to 40 carbon atoms or a substituted or unsubstituted aryl group having from 6 to 40 carbon atoms; $G^{53}$ represents an electrophilic group such as —CO—or —CS—; $G^{54}$ represents an oxygen atom, a sulfur atom, a selenium atom, or a nitrogen atom, and when $G^{54}$ represents a nitrogen atom, it has bonded thereto a hydrogen atom or may be substituted with an alkyl group or a substituted alkyl group having from 1 to 10 carbon atoms or an aromatic residue having from 6 to 20 carbon atoms; $G^{55}$, $G^{56}$ and $G^{57}$ and each represents a hydrogen atom, a halogen atom, a carbonyl group, a sulfamyl group, a sulfonamido group, an alkoxy group having from 1 to 40 carbon atoms or an optional group defined for $G^{52}$, or $G^{55}$ and $G^{56}$ may together form a 5-membered to 7-membered ring, $G^{56}$ or may represent

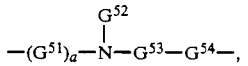

with the proviso that at least one of $G^{52}$, $G^{55}$, and $G^{57}$ represents a ballast group. Specific examples of this type of Y are described in JP-A-51-63618.

Further examples f Y suited for this type of compound are those which are represented by the following general formulae (YVIII) and (YIX):

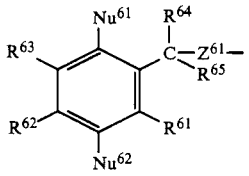

(YVIII)

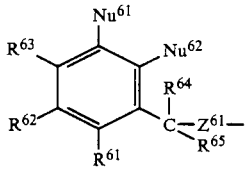

(YIX)

wherein $Nu^{61}$ and $Nu^{62}$, which may be the same or different, each represents a nucleophilic group or a precursor thereof; $Z^{61}$ represents a divalent atom group which is electrically negative with respect to the carbon atom substituted by $R^{64}$ and $R^{65}$; $R^{61}$, $R^{62}$ and $R^{63}$ each represents a hydrogen atom, a halogen atom, an alkyl group, an alkoxy group or an acylamino group or, when located at adjacent positions on the ring, and $R^{62}$ and $R^{62}$ may form a fused ring together with the rest of the molecule, or $R^{62}$ and $R^{63}$ may form a fused ring together with the rest of the molecule; $R^{64}$ and $R^{65}$, which may be the same or different, each represents a hydrogen atom, a hydrocarbon group or a substituted hydrocarbon group; with at least one of the substituents, $R^{61}$, $R^{62}$, $R^{63}$, $R^{64}$ and $R^{65}$ having a ballast group, Ball, of an enough size so as to render the above-described compounds immobile. Specific examples of this type of Y are described in JP-A-53-69033 and JP-A-54-130927.

Further examples of Y suited for this type of compound are those which are represented by the following general formula (YX):

(YX)

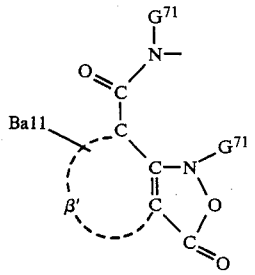

wherein Ball and $\beta'$ each has the same meaning as defined in the general formula (YII), and $G^{71}$ represents an alkyl group (including a substituted alkyl group). Specific examples of this type of Y are described in JP-A-49-111628 and JP-A-52-4819.

As a different type of compound represented by the general formula (I), there are illustrated nondiffusible image forming compounds which themselves do not release any dye but, upon reaction with a reducing agent, release a dye. With these compounds, compounds which mediate the redox reaction (called electron donors) are preferably used in combination therewith.

Examples of Y effective for this type of compound are those represented by the following general formula (YXI):

(YXI)

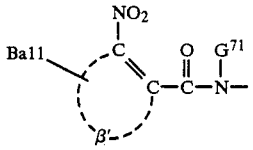

wherein Ball and $\beta'$ each has the same meaning as defined in the general formula (YII), and $G^{71}$ represents an alkyl group (including a substituted alkyl group). Specific examples of this type of Y are described in JP-A-53-35533 and JP-A-53-11082.

Further examples of Y suited for this type of compound are those which are represented by the following general formula (YXII):

(YXII)

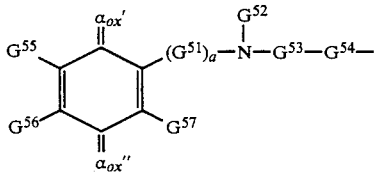

wherein $\alpha'_{ox}$ and $\alpha''_{ox}$ represent groups capable of giving $\alpha''$ and $\alpha'''$, respectively, upon reduction, and $\alpha''$ and $\alpha'''$, $G^{51}$, $G^{52}$, $G^{53}$, $G^{54}$, $G^{55}$, $G^{56}$, $G^{57}$ and a each has the same meaning as defined in the general formula (YVII). Specific examples of the type of Y are described in JP-A-110827, U.S. Pat. Nos. 4,356,249 and 4,358,525.

Further examples of Y suited for this type of compound are those which are represented by the following general formulae (YXIIIA) and (YXIIIB):

(YXIIIA)

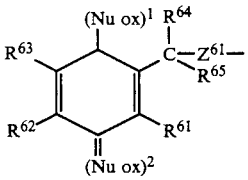

(YXIIIB)

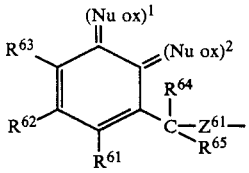

wherein $(Nuox)^1$ and $(Nuox)^2$, which may be the same or different, each represents an oxidized nucleophilic group, and other notations each has the same meaning as defined in the general formulae (YVIII) and (YIX). Specific examples of these types of Y are described in JP-A-54-130927 and JP-A-56-164342.

The patents referred to with respect to the compounds of the general formulae (YXI), (YXII), (YXIIIA) and (YXIIIB) also describe electron donors to be used in combination therewith.

Furthermore, more preferred examples of Y include compounds containing both N—X, groups (wherein X' represents an oxygen atom, a sulfur atom or a nitrogen atom) and an electron withdrawing group in their molecule as described, for example, in European Patent No. 220,746 A2, U.S. Pat. No. 4,783,396, Kokai Giho 87-6199, Japanese Patent Application Nos. 62-34953 and 62-34954; compounds containing both an $SO_2$—X' group (wherein X, has the same meaning as defined above) and an electron withdrawing group in their molecule as described, for example, in Japanese Patent Application No. 62-106885; compounds containing both a PO-X' group (wherein X' has the same meaning as defined above) and an electron withdrawing group in their molecule as described, for example, in Japanese Patent Application No. 62-106895; and compounds containing both a C-X'' group (wherein X'' has the same meaning as above or represents —$SO_2$—) and an electron withdrawing group in their molecule as described, for example, in Japanese Patent Application No. 62-106887.

Particularly preferred compounds of these represented by the general formula (I) contain a moiety represented by the general formula (YXIV) described below as Y.

(YXIV)

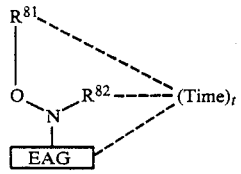

wherein EAG represents a group which accepts an electron from a reducing substance; $R^{81}$ and $R^{82}$ each represents a substituent other than a hydrogen atom, and when $R^{81}$ or $R^{82}$ is bonded to $(Time)_t$, $R^{82}$ or $R^{82}$ is a chemical bond or a substituent other than a hydrogen atom, or $R^{81}$ and $R^{82}$ may combine with each other to form a ring; Time represents a group capable of releasing Dye via the subsequent reaction triggered by the cleavage of the nitrogen-oxygen single bond in the moiety represented by the general formula (YXIV); t represents 0 or 1; at least one of the dotted lines means a bond.

Specific examples of this type of Y are described in JP-A-62-215270. Among them, those represented by the general formula (YXV) are particularly preferably employed in the present invention.

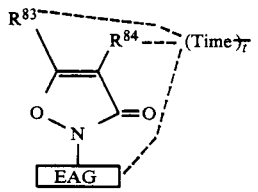

(YXV)

wherein $R^{82}$ and $R^{84}$ each represents a simple bond, a hydrogen atom or a substituent group, or $R^{83}$ and $R^{84}$ may combine with each other to form a saturated or unsaturated carbon ring or hetero ring; and EAG, Time and t each has the same meaning as defined in the general formula (YXIV).

It is preferred that the moieties represented by the general formula (YXIV) or (YXV) have a ballast group in at least one group represented by $R^{81}$, $R^{82}$, $R^{83}$, $R^{84}$ or EAG.

The ballast group used in the general formulae (YI) to (YXV) is an organic ballast group which can render the dye image forming compound represented by the general formula (I) nondiffusible, and is preferably a group containing a hydrophobic group having from 8 to 32 carbon atoms. Such an organic ballast group is connected to the dye image forming compound directly or through a linking group (for example, an imino bond, an ether bond, a thioether bond, a carbonamido bond, a sulfonamido bond, a ureido bond, an ester bond, a carbamoyl bond, a sulfamoyl bond, or a combination thereof).

Specific examples of the compounds represented by the general formula (I) are set forth below, but the present invention should not be construed as being limited thereto.

(1)

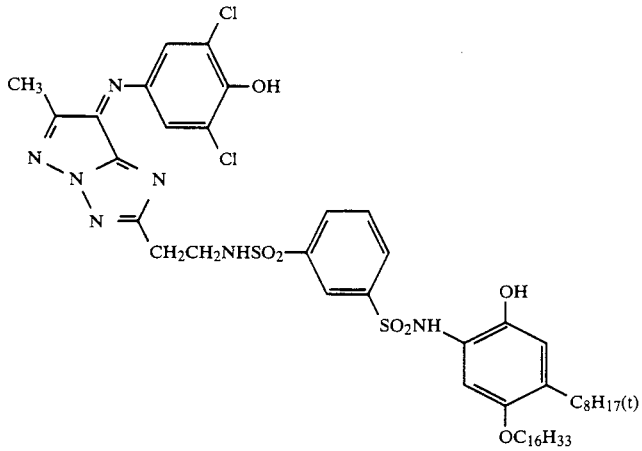

(2)

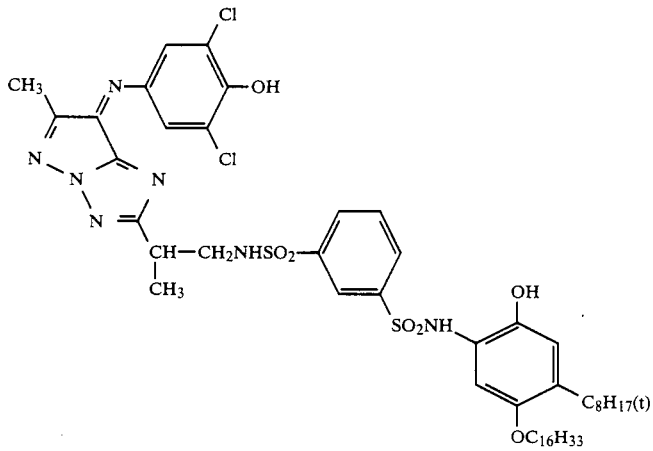

-continued
(3)
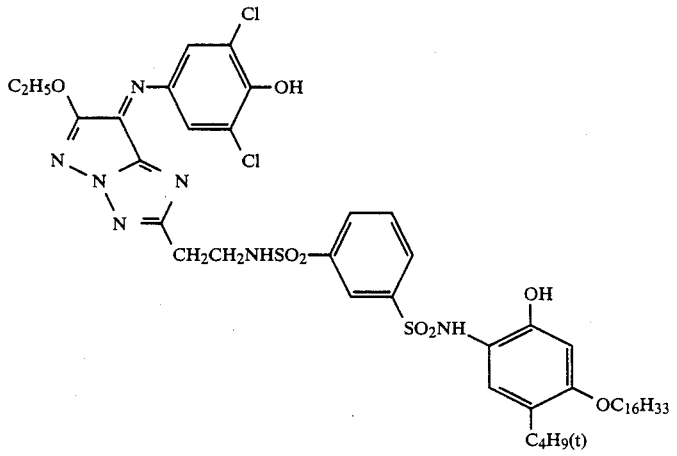
(4)
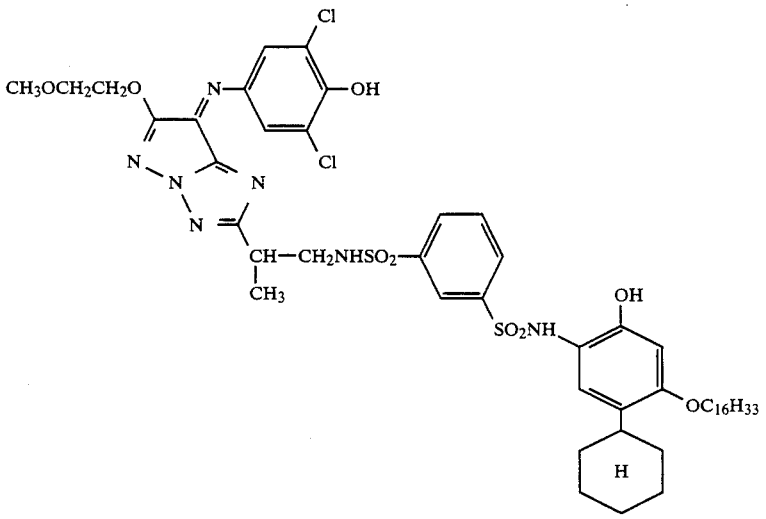
(5)
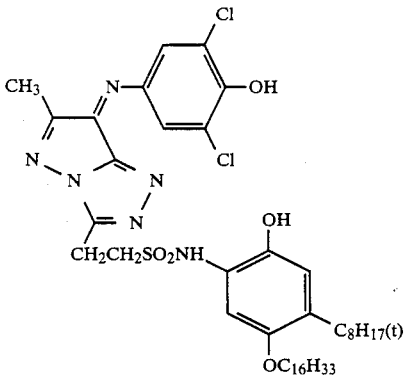

-continued
(6)
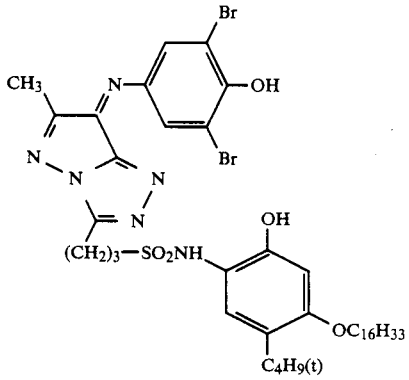
(7)
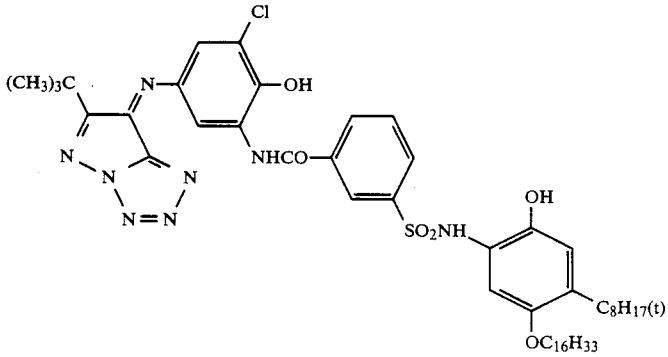
(8)
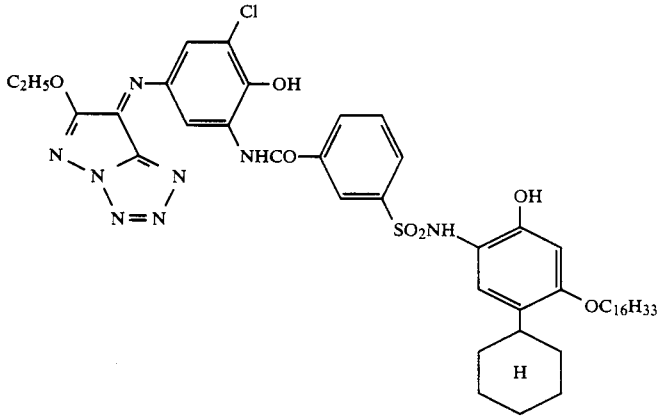
(9)
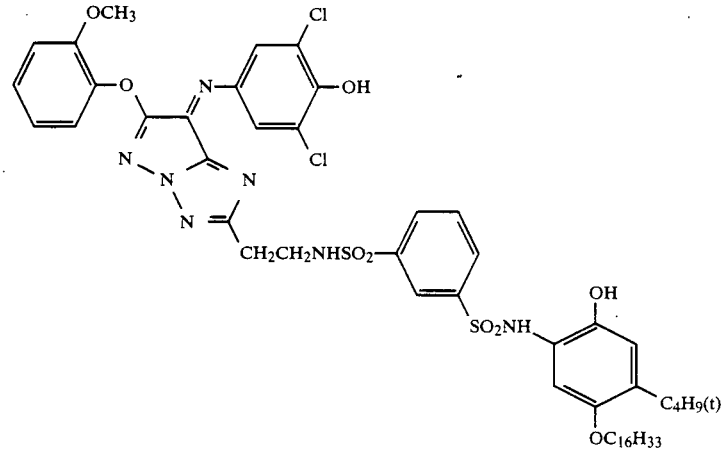

-continued
(10)
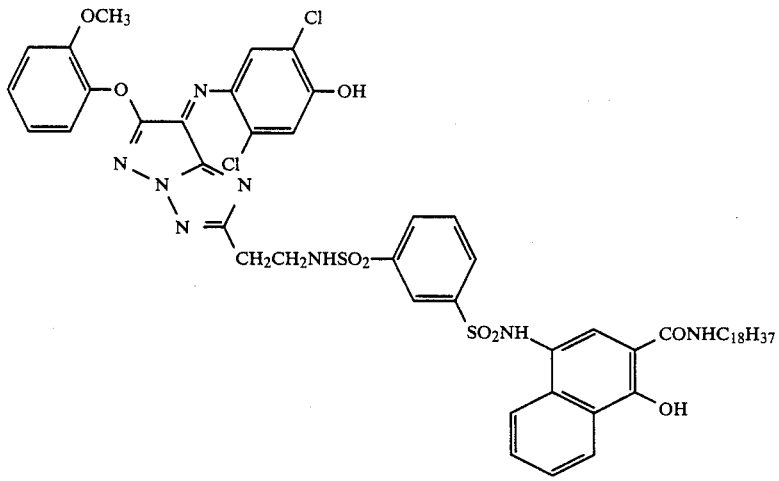
(11)
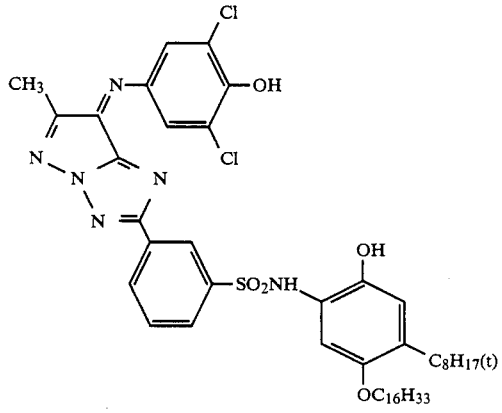
(12)
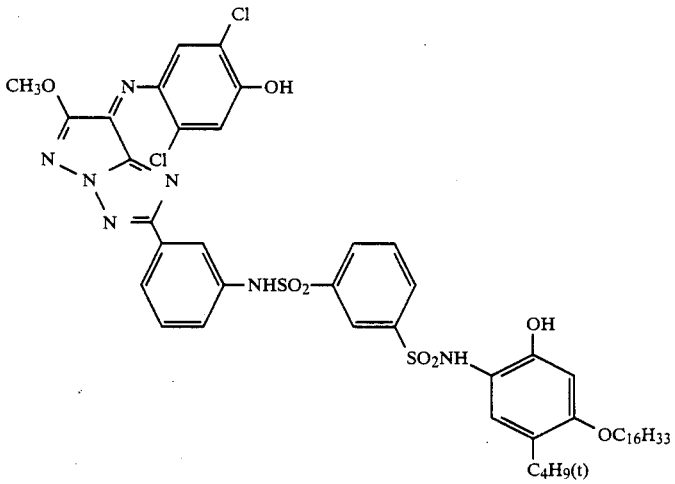

-continued
(13)
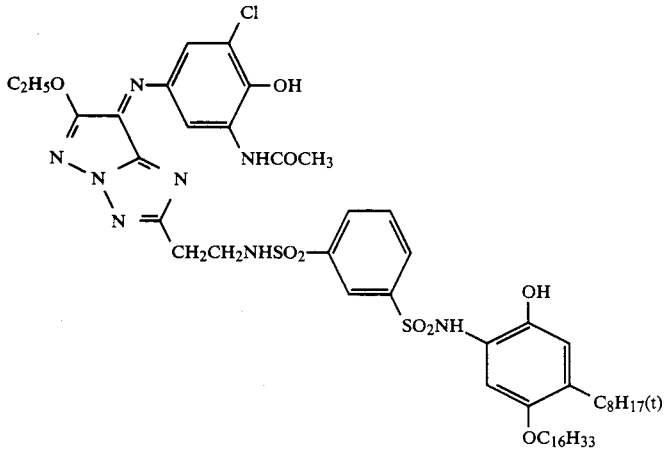
(14)
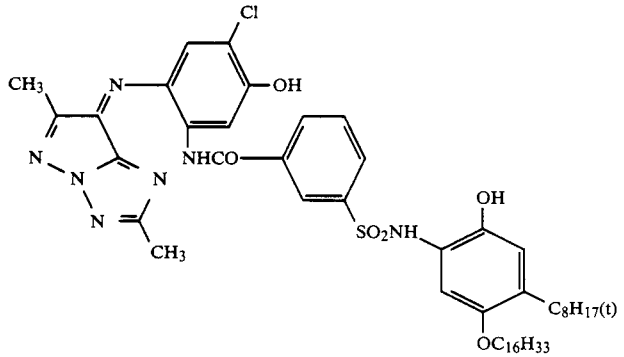
(15)
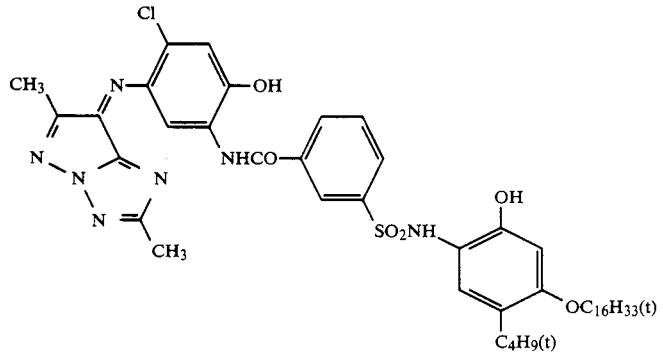
(16)
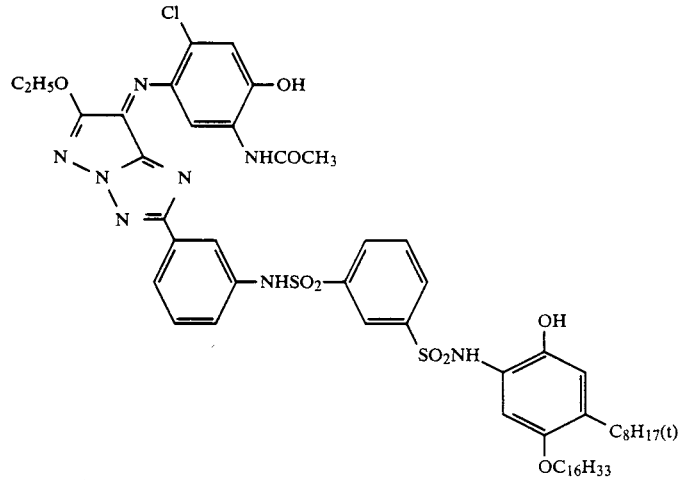

-continued
(17)
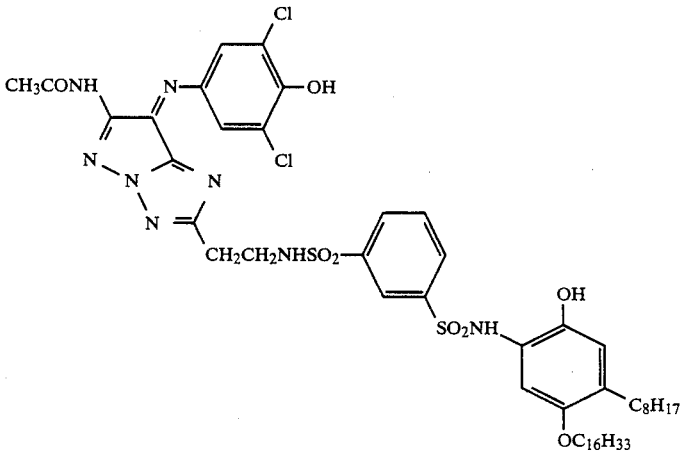
(18)
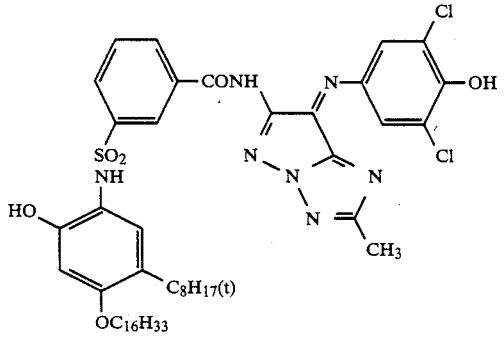
(19)
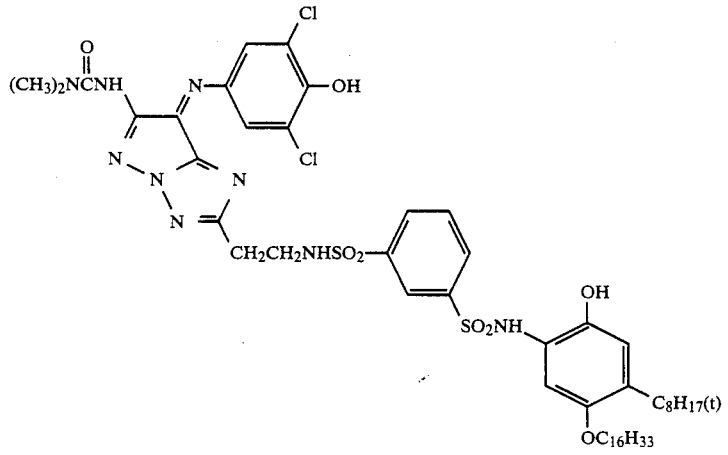

-continued
(20)
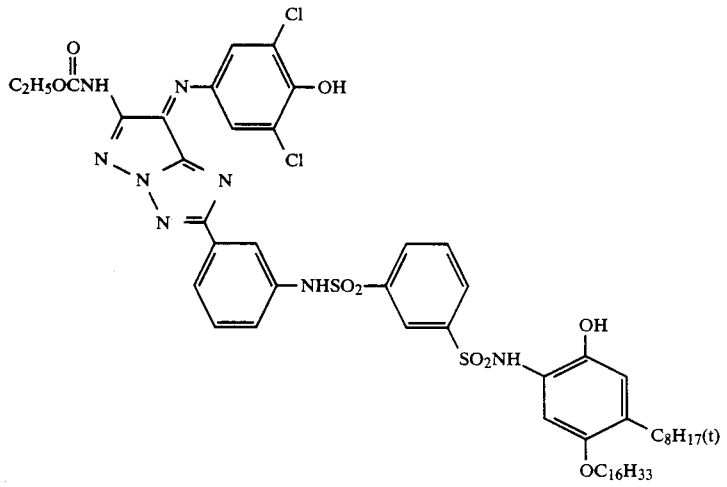
(21)
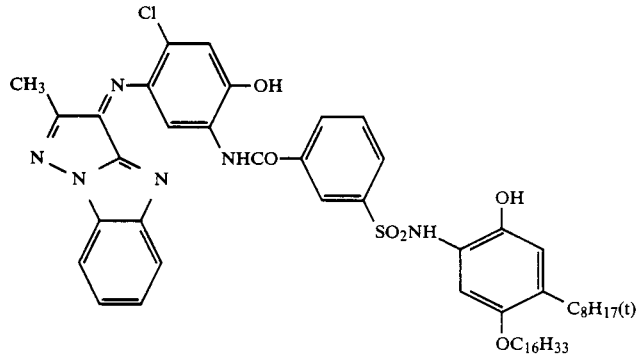
(22)
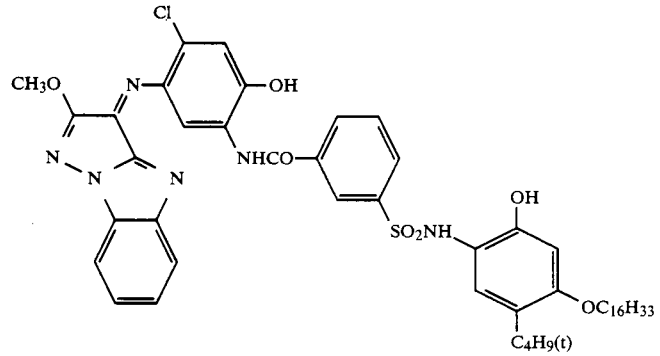
(23)
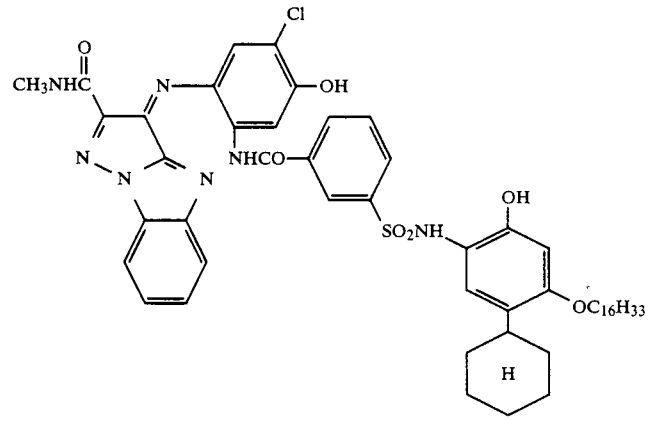

-continued
(24)
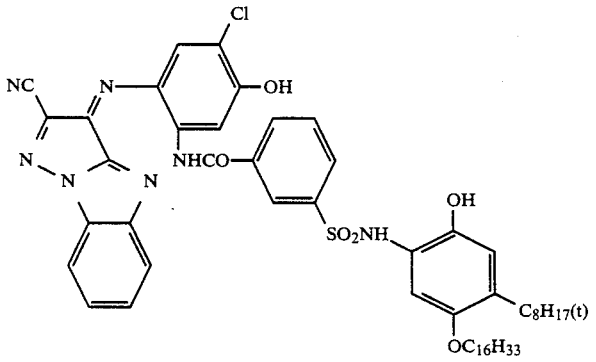
(25)
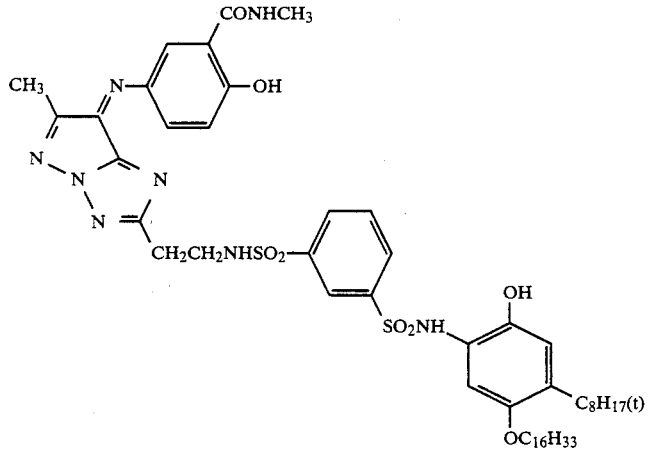
(26)
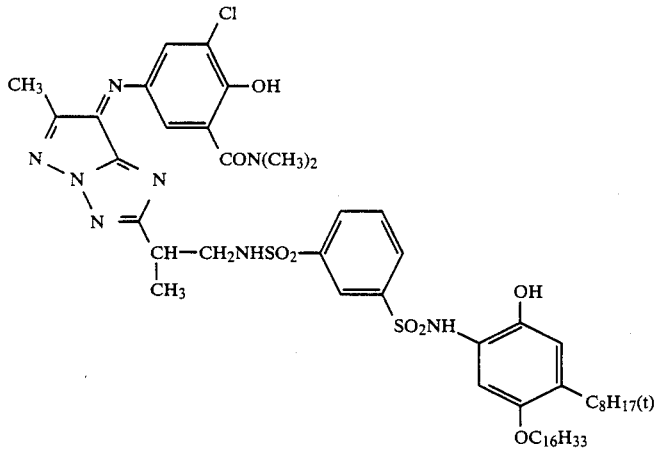

-continued
(27)
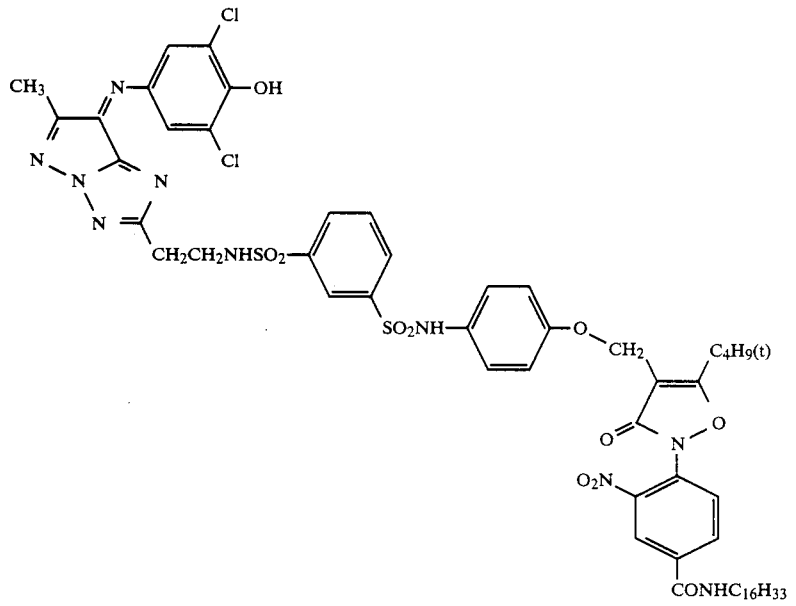
(28)
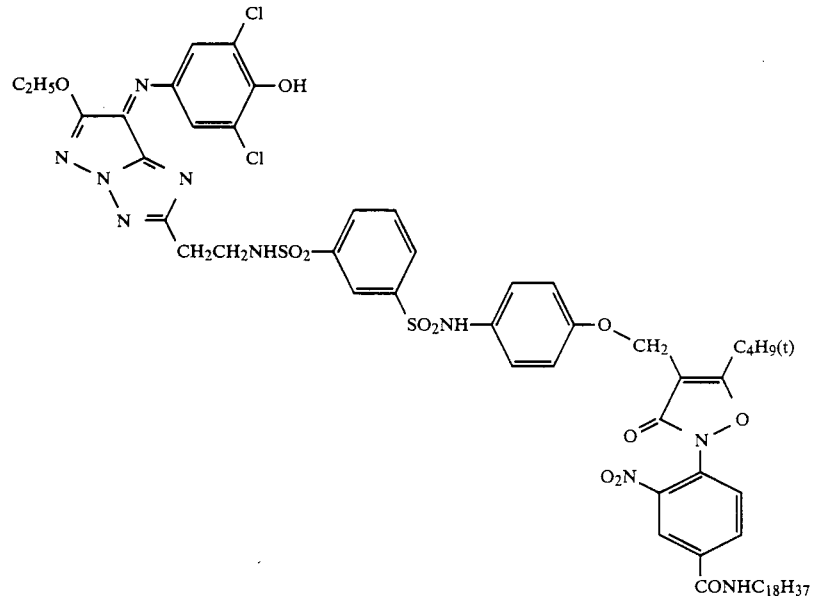

-continued
(29)
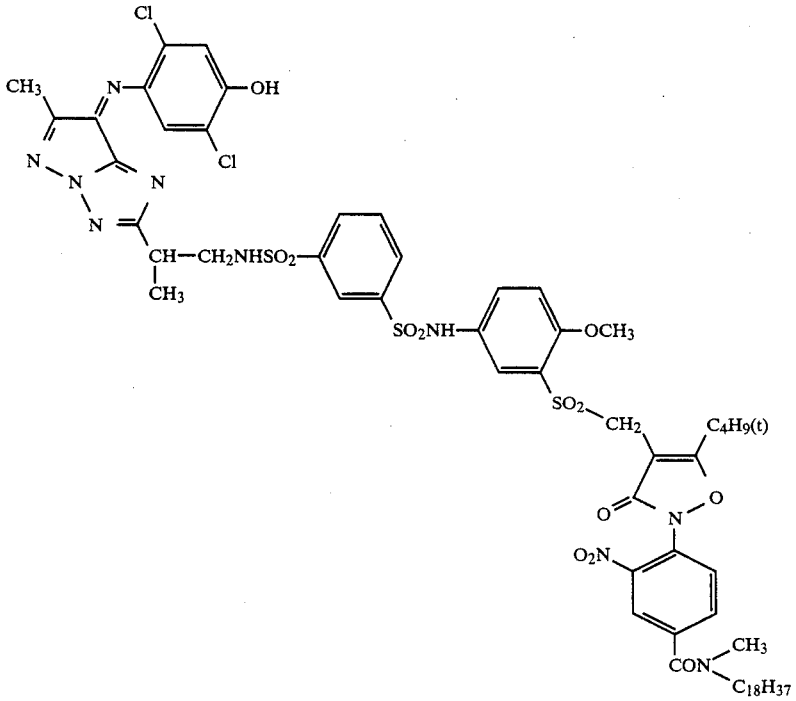
(30)
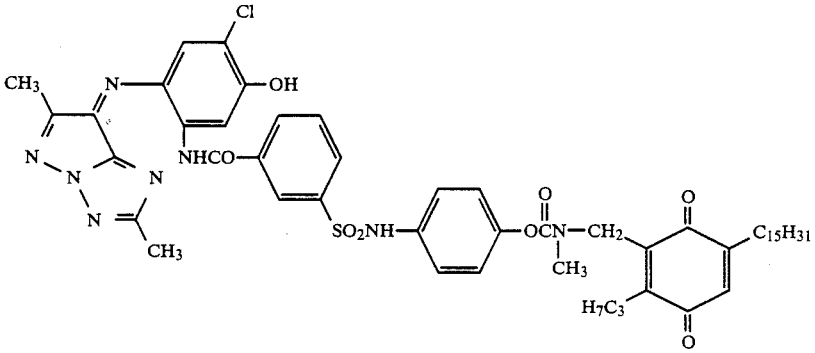
(31)
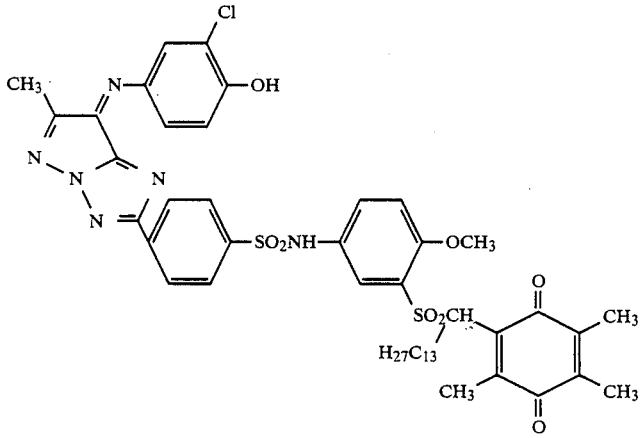

-continued (32)

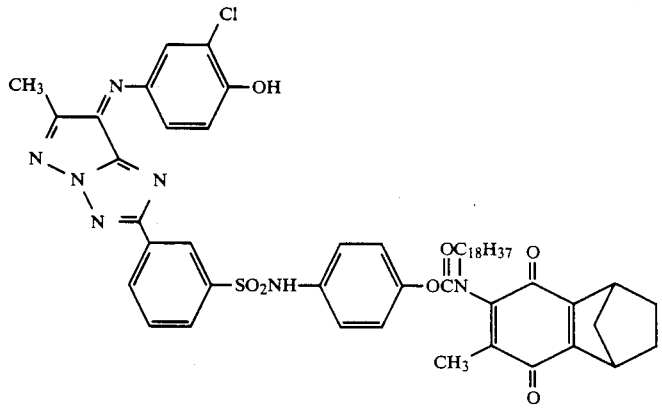

(33)

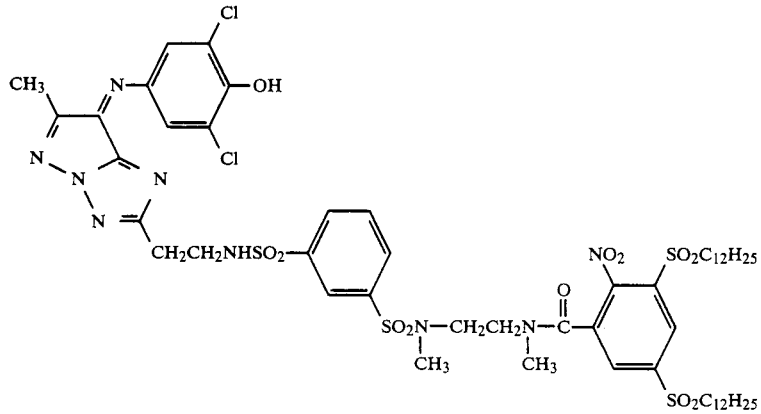

Among the above compounds, Compounds (1), (3), (9), (11) and (13) are particularly preferred.

Methods for synthesis of the image forming compounds according to the present invention will now be described. The image forming compound according to the present invention has the structural feature that the dye moiety contains a condensed pyrazole skeleton, and the dye skeleton thereof can be usually completed upon oxidative coupling of a pyrazoloazole having an active methylene group or an active methine group with a p-aminophenol. A method for connecting the dye skeleton to the substrate Y having an imaging function may be varied depending on the type of Y and the dye skeleton. However, the coupling can be generally performed according to Scheme (A), (B) or (C) described below.

Scheme (A):

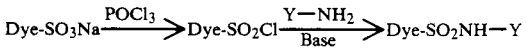

Scheme (B):

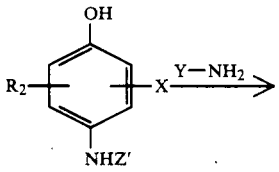

-continued

Scheme (B):

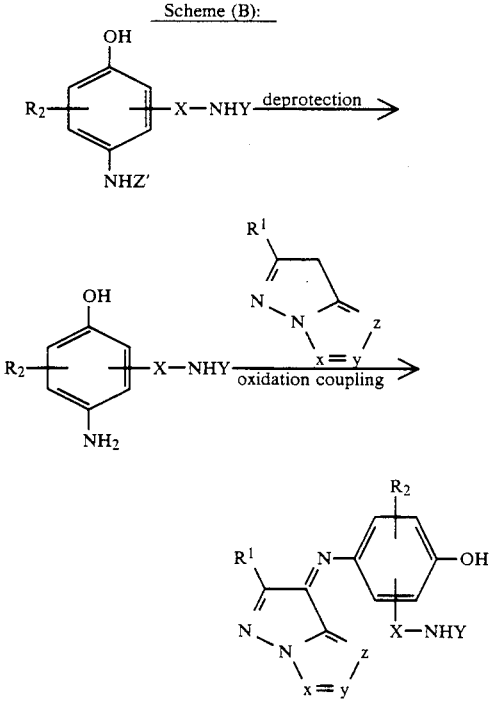

Scheme (C):
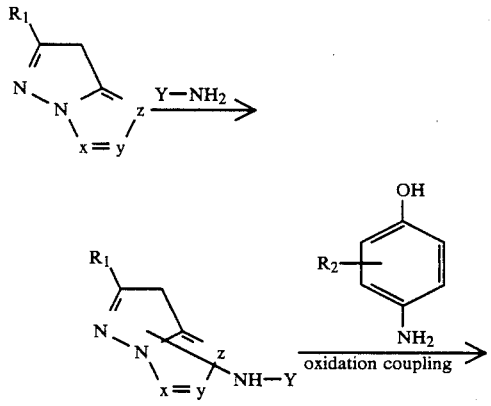
-continued
Scheme (C):
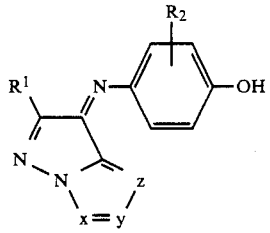
A synthesis example of the compound according to the present invention is specifically illustrated below.
Synthesis of Image Forming Compound (1)
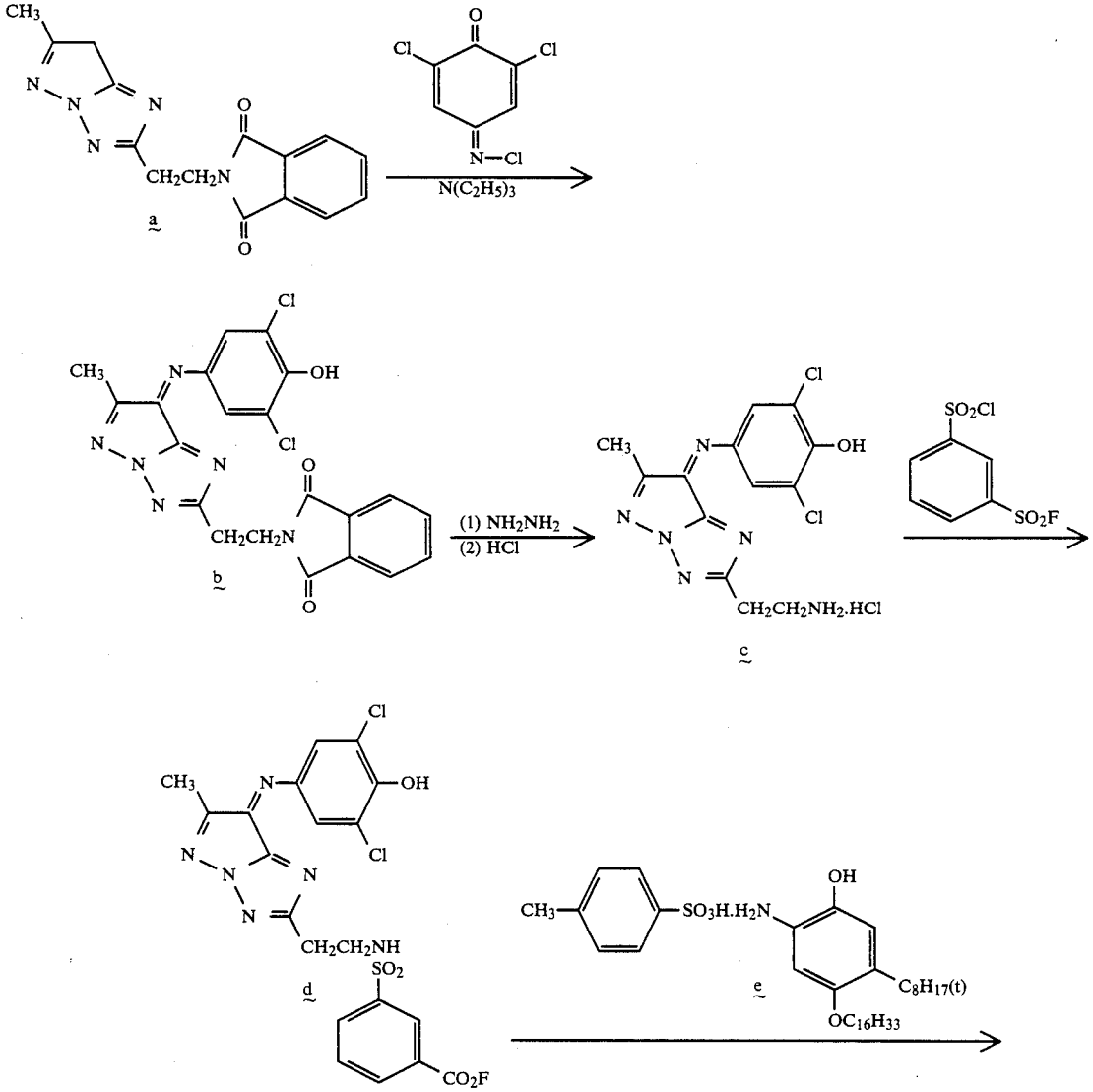

-continued

Synthesis of Image Forming Compound (1)

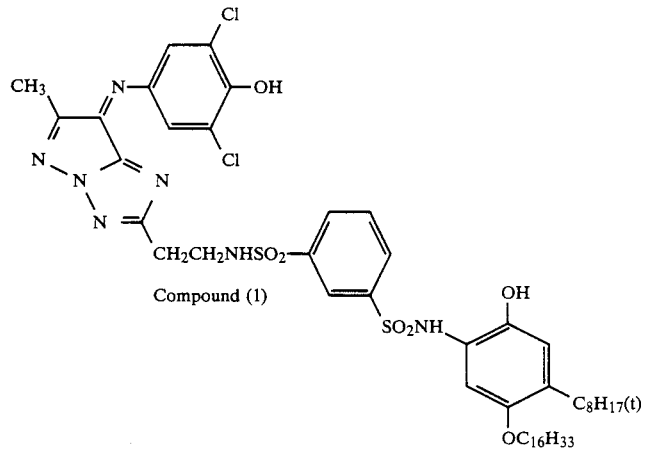

(1) Synthesis of Compound b

To a mixture of 30 g of Compound a synthesized by the method as described in JP-A-61-261738, 30.3 g of triethylamine and 200 ml of dimethylformamide, 23.2 g of 2,6-dichloroquinone-4-chloroimide were added dropwise under cooling with ice. After the completion of the addition, the mixture was stirred at room temperature for 30 minutes, and then the reaction solution was poured into cold diluted hydrochloric acid. The precipitate thus-formed was collected by filtration and washed with water. The crude product was recrystallized from ethyl acetate to obtain 34.3 g of Compound b.

(2) Synthesis of Compound c

To a mixture of 23.5 g of Compound b and 1 liter of methanol, 5.0 g of 90% hydrazine hydrate were added and the mixture was heated at 50° C. for 5 hours with stirring. After cooling, 10 ml of hydrochloric acid was added to the reaction solution, and the solvent was distilled off under a reduced pressure. The residue was dissolved by adding 100 ml of water and heating, and the insoluble substance was removed by filtration. The filtrate was concentrated under a reduced pressure and the orange crystals thus-formed were collected by filtration. Yield of Compound c: 12.8 g.

(3) Synthesis of Image Forming Compound (1)

10.9 g of Compound c was dissolved in 50 ml of dried dimethylacetamide and to the solution were added 10.1 g of triethylamine and 7.9 g of pyridine. Then, under cooling with ice, 7.8 g of 3-fluorosulfonylbenzenesulfonyl chloride was added dropwise thereto. After stirring at room temperature for 10 minutes, 19.1 g of Compound e, synthesized by the method as described in JP-A-59-60434, was added thereto under a nitrogen atmosphere, and the mixture was gradually heated to 60° C. After stirring at 60° C. for 1 hour, the reaction solution was poured into cold diluted hydrochloric acid and extracted with ethyl acetate. The extract was washed with water and dried with anhydrous magnesium sulfate. The solvent was distilled off under a reduced pressure, and the residue was purified by silica gel chromatography (eluate: ethyl acetate and hexane =1/1) to obtain 8.9 g of Image Forming Compound (1) as yellow-orange crystals having a melting point of 165° C. to 169° C. λmax in dimethylformamide: 557 nm. The visible absorption spectrum of the compound is shown in FIG. 1.

The image forming compound according to the present invention is preferably incorporated in the emulsion layers or the layers adjacent to the emulsion layers of the light-sensitive material.

The added amount of the image forming compound according to the present invention is generally from 0.1 to 2 g/m$^2$,and preferably from 0.2 to 0.6 g/m$^2$.

The image forming compound according to the present invention can be employed individually or may be employed together with a reducing substance which is capable of reducing exposed silver halide and conducting cross-oxidation with the compound according to the present invention. As the reducing substances, while various compounds can be employed, hydroquinones, 3-pyrazolidones, aminophenols, catechols, p-phenylenediamines, aminonaphthols, and reductones are preferred.

Further, precursors which form reducing compounds as described above by hydrolysis under an alkaline condition may also be employed. Suitable examples thereof are described, for example, in JP-A-55-52055, JP-B-54-39727 and JP-A-57-135949.

Specific examples of more preferred reducing compounds include the following compounds: 3-pyrazolidones (for example, 1-phenyl-3-pyrazolidone, 1-phenyl-4,4-dimethyl-3-pyrazolidone, 4-hydroxymethyl-4-methyl-1-phenyl-3-pyrazolidone, 1-m-tolyl-3-pyrazolidone, 1-p-tolyl-3-pyrazolidone, 1-phenyl-4-methyl-3-pyrazolidone, 1-phenyl-5-methyl-3-pyrazolidone, 1-phenyl-4,4-bis(hydroxymethyl)-3-pyrazolidone, 1,4-dimethyl-3-pyrazolidone, 4-methyl-3-pyrazolidone, 4,4-dimethyl-3-pyrazolidone, 1-(3-chlorophenyl)-4-methyl-3-pyrazolidone, 1-(4-chlorophenyl)-4-methyl-3-pyrazolidone, 1-(4-tolyl)-4-methyl-3-pyrazolidone, 1-(2-tolyl)-4-methyl-3-pyrazolidone, 1-(4-tolyl)-3-pyrazolidone, 1-(3-tolyl)-3-pyrazolidone, 1-(3-tolyl)4,4-dimethyl-3-pyrazolidone, 1-(2-trifluoroethyl)-4,4-dimethyl-3-pyrazolidone, 5-methyl-3-pyrazolidone, 1,5-diphenyl-3-pyrazolidone, 1-phenyl-4-methyl-4-stearoyloxymethyl-3-pyrazolidone, 1-phenyl-4-methyl-4-lauroyloxymethyl-3-pyrazolidone, 1-phenyl-4,4-bis-(lauroyloxymethyl)-3-pyrazolidone, 1-phenyl-2-acetyl-3-pyrazolidone, and 1-phenyl-3-acetoxypyrazolidone); hydroquinones (for example, hydroquinone, toluhydroquinone, 2,6-dimethylhydroquinone, tert-butylhydroquinone, 2,5-di-tert-butylhydroquinone, tert-octylhydroquinone, 2,5-di-tert-octylhydroquinone, pentadecylhydroquinone, sodium 5-pentadecylhydroquinone-2-sulfonate, p-benzoyloxyphenol, 2-methyl-4-benzoyloxyphenol, and 2-tert-butyl-4-(4-chlorobenzoyloxyphenol); aminophenols (for example, 4-amino-2,6-dichlorophenol, 4-amino-2,6-dibromophenol, 4-amino-2-methylphenol sulfate, 4-amino-3-methylphenol sulfate, 4-amino-2,6-dichlorophenol hydrochloride, p-aminophenol, p-methylaminophenol, p-dimethylaminophenol, p-diethylaminophenol, p-dibutylaminophenol, p-piperidinoaminophenol, and 4-dimethylamino-2,6-dimethoxyphenol); phenylenediamines (for example, N-methyl-p-phenylenediamine, N,N-dimethyl-p-phenylenediamine, N,N-diethyl-p-phenylenediamine, N,N,N',N,-tetramethyl-p-phenylenediamine, and 4-diethylamino-2,6-dimethoxyaniline); and reductones (for example, piperidinohexose reductone and pyrrolidinohexose reductone).

Moreover, 2,6-dichloro-4-substituted sulfonamidophenols and 2,6-dibromo-4-substituted sulfonamidophenols as described in *Research Disclosure,* Vol. 151, No. 15108 and U.S. Pat. No. 4,021,240; and p-(N,N-dialkylaminophenol)sulfamines as described in JP-A-59-116740 are also useful.

In addition to the phenolic reducing agents described above, naphtholic reducing agents, for example, 4-aminonaphthol derivatives and 4-substituted sulfonamidonaphthol derivatives are useful.

These reducing substances and precursors thereof can be employed individually or in combination of two or more thereof.

The silver halide which can be used in the present invention may include any of silver chloride, silver bromide, silver iodide, silver chlorobromide, silver chloroiodide, silver iodobromide, and silver chloroiodobromide.

A halogen composition in the silver halide grains may be uniform, or the silver halide grains may have a multiple structure in which the composition is different between a surface portion and an interior portion (as described, e.g., in JP-A-57-154232, JP-A-58-108533, JP-A-59-48755, JP-A-59-52237, U.S. Pat. No. 4,433,048 and European Patent No. 100,984).

Also, a tabular grain silver halide emulsion containing grains having a thickness of 0.5 μm or less, a diameter of at least 0.6 μm and an average aspect ratio of 5 or more (see, for example, U.S. Patents 4,414,310 and 4,435,499, and West German Patent Application (OLS) No. 3,241,646Al), or a monodispersed emulsion having a nearly uniform distribution of grain size (see, for example, JP-A-57-178235, JP-A-58-100846, JP-A-58-14829, PCT Application (OPI) No. 83/02338Al, and European Patents 64,412A3 and 83,377Al) may be used in the present invention.

Two or more kinds of silver halides in which a crystal habit, a halogen composition, a grain size and/or a distribution of grain size, etc., are different from each other may be used in admixture. Further, two or more kinds of monodispersed emulsions having different grain size from each other may be employed as a mixture to control gradation.

An average grain size of the silver halide used in the present invention is preferably from 0.001 μm to 10 μm, and more preferably from 0.001 μm to 5 μm.

The silver halide emulsions can be prepared by any of an acid process, a neutral process, and an ammonia process. Further, a reaction system of soluble silver salts and soluble halogen salts may be any of a single jet process, a double jet process and a combination thereof. In addition, a reverse mixing process in which silver halide grains are formed in the presence of an excess of silver ions, or a controlled double jet process in which the pAg in the liquid phase is kept constant, can also be utilized.

Moreover, for the purpose of increasing growth of grains, a concentration of addition, the amount of addition and/or speed of addition of silver salts and halogen salts added may be increased (as described, for example, JP-A-55-142329, JP-A-55-158124, and U.S. Pat. No. 3,650,757).

Furthermore, silver halide grains of epitaxial junction type (see, for example, JP-A-56-16124 and U.S. Pat. No. 4,094,684) may be employed.

In the step for formation of silver halide grains used in the present invention, ammonia, an organic thioether derivative as described in JP-B-47-11386, or a compound containing sulfur as described in JP-A-53-144319, etc., can be used as a silver halide solvent.

In a process of the formation or physical ripening of silver halide grains, a cadmium salt, a zinc salt, a lead salt, or a thallium salt, etc., may be present.

Further, for the purpose of preventing high intensity reciprocity failure or low intensity reciprocity failure, a water-soluble iridium salt such as iridium (III or IV) chloride, or ammonium hexachloroiridate or a water-soluble rhodium salt such as rhodium chloride can be used.

Soluble salts may be removed from the silver halide emulsion after precipitate formation or physical ripening, and a noodle washing process or a flocculation process can be used for this purpose.

While the silver halide emulsion may be employed without being subjected to after-ripening, it is usually chemically sensitized. For the chemical sensitization, a sulfur sensitization method, a reduction sensitization method, and a noble metal sensitization method, etc., which are known in the field for conventional type photographic light-sensitive materials, can be applied alone or in combination. Such a chemical sensitization may be carried out in the presence of a nitrogen-containing heterocyclic compound (see, for example, JP-A-58-126526 and JP-A-58-215644).

The silver halide emulsion used in the present invention can be that of a surface latent image type in which a latent image is formed mainly on the surface of grains, or that of an internal latent image type in which a latent image is formed mainly in the interior of grains. Further, a direct reversal emulsion in which an internal latent image type emulsion and a nucleating agent and/or light fogging are used in combination may be used. Examples of the internal latent image type emulsions suitable for this purpose are described, for example, in U.S. Patents 2,592,250 and 3,761,276, JP-B-58-3534 and JP-A-57-136641. Preferred examples of the nucleating agents used in the present invention are described, for example, in U.S. Pat. Nos. 3,227,552, 4,245,037, 4,255,511, 4,266,031 and 4,276,364, and West German Patent Application (OLS) No. 2,635,316. With respect to the light fogging, known methods as described, for example, in JP-B-45-12710 and JP-A-61-159641, can be employed.

The silver halide used in the present invention can be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, styryl dyes, and hemioxonol dyes. Among these dyes, cyanine dyes, merocyanine dyes and complex merocyanine dyes are particularly useful. Any conventionally utilized nucleus for cyanine dyes is applicable as a basic heterocyclic nucleus. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, pyridine nucleus, etc., and further, nuclei formed by condensing an alicyclic hydrocarbon ring with these nuclei and nuclei formed by condensing an aromatic hydrocarbon ring with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei may also be substituted.

To merocyanine dyes and complex merocyanine dyes, nuclei having a ketomethylene structure, 5-membered or 6-membered heterocyclic nuclei such as a pyrazolin-5-one nucleus, a thiohydantoin nucleus, a 2-thiooxazolidin-2,4-dione nucleus, a thiazolidin-2,4-dione nucleus, a rhodanine nucleus, a thiobarbituric acid nucleus, etc., may also be applicable.

These sensitizing dyes can be employed individually or in combinations thereof. A combination of sensitizing dyes is often used, particularly for the purpose of supersensitization.

The sensitizing dyes may be present in the emulsion together with dyes which themselves do not give rise to spectrally sensitizing effects but which exhibit a supersensitizing effect or materials which do not substantially absorb visible light but which also exhibit a supersensitizing effect. For example, aminostilbene compounds substituted with a nitrogen-containing heterocyclic group (for example, those described in U.S. Pat. Nos. 2,993,390 and 3,635,721), aromatic organic acidformaldehyde condensates (for example, those described in U.S. Pat. No. 3,743,510), cadmium salts, or azaindene compounds can be present. The combinations as described in U.S. Pat. Nos. 3,615,613, 3,615,641, 3,617,295 and 3,635,721 are particularly useful.

Gelatin is preferably used as the binder or protective colloid in the emulsion layers or intermediate layers of the photographic light-sensitive materials of the present invention, but other conventional hydrophilic colloids may be used alone or together with gelatin.

The gelatin may be either a lime-treated gelatin or acid-treated gelatin in the present invention. Details on the preparation of gelatins are given in *The Macromolecular Chemistry of Gelatin,* written by Arther Vaise, published by Academic Press, 1964.

The photographic emulsion used in the present invention may contain one or more surfactants singly or in the form of a mixture thereof.

These are essentially used as a coating aid and sometimes for some other purposes such as emulsification and dispersion, improvement of photographic characteristic for sensitization, static charge prevention and blocking prevention. These surfactants are classified into natural surfactants such as saponin; nonionic surfactants such as alkylene oxide type, glyceral type or glycidol type surfactants; cationic surfactants such as higher alkylamines, quaternary ammonium salts, pyridine and the like heterocyclic compounds or phosphonium or sulfonium salts; an anionic surfactants containing an acidic group such as a carboxylic acid, sulfonic acid, phosphoric acid, sulfate or phosphate group; and amphoteric surfactants such as amino acids, aminosulfonic acids or aminoalcohol sulfate or phosphate.

The photographic emulsion used in the present invention may contain various compounds for the purpose of the prevention of fog formation during production, storage or photographic processing of the photographic material, or for the purpose of stabilization of the photographic characteristic of the material. For these purposes, various compounds which are known as anti-fogging agents or stabilizers may be used, including azoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (especially 1-phenyl-5-mercaptotetrazole); mercaptopyrimidines; mercaptotriazines; thioketo compounds such as oxazolinethione; azaindenes such as triazaindenes, tetraazaindenes (especially 4-hydroxy-substituted (1,3,3a,7-tetraazaindenes), pentaazaindenes, and benzenethiosulfonic acid, benzenesulfinic acid and benzenesulfonic acid amide.

The photographic emulsion layer of the photographic light-sensitive material of the present invention may contain, for the purpose of increasing sensitivity, intensification of contrast or acceleration of development, for example, thioether compounds, thiomorpholines, quaternary ammonium salt compounds, urethane derivatives, urea derivatives, imidazole derivatives or 3-pyrazolidones.

The photographic light-sensitive material according to the present invention may further contain, in the photographic emulsion layers or in any other hydrophilic colloid layers, a water-insoluble or sparingly soluble synthetic polymer dispersion for the purpose of the improvement of the dimensional stability of the photographic material. Polymers usable for this purpose are homopolymers or copolymers of alkyl (meth)acrylate, alkoxyalkyl (meth)acrylates, glycidyl (meth)acrylates, (meth)acrylamides, vinyl esters (such as vinyl acetate), acrylonitriles, olefins and/or styrenes; as well as copolymers made of a combination of the above-described monomers and other monomer components such as acrylic acid, methacrylic acid, $\alpha,\beta$-unsaturated dicarboxylic acids, hydroxyalkyl (meth)acrylates, sulfoalkyl (meth)acrylates and styrenesulfonic acids.

The present photographic materials may contain in the photographic emulsion layers, or in any other hydrophilic colloid layers, an inorganic or organic hardener. For example, chromium salts (such as chromium alum, chromium acetate), aldehydes (such as formaldehyde, glyoxal, glutaraldehyde), N-methylol compounds (such as dimethylolurea, methyloldimethylhydantoin), dioxane derivatives (such as 2,3-dihydroxydioxane), active vinyl compounds (such as 1,3,5-triacryloyl-hexahydro-s-triazine, 1,3-vinylsulfonyl-2-propanol), active halogen-containing compounds (such as 2,4-dichloro-6-hydroxy-s-triazine), mucohalogenic acids (such as mucochloric acid, mucophenoxychloric acid) and like hardeners may be used singly or in combination.

The silver halide photographic material of the present invention may contain various other conventional additives, for example, hardening agents, whitening agents, dyes, desensitizers, coating aids, antistatic agents, plasticizers, sliding agents, matting agents, development accelerating agents, mordanting agents, ultraviolet light absorbing agents, color fading preventing agents and color fog preventing agents.

Examples of such additives are described, for example, in *Research Disclosure,* Vol. 176, No. 17643 (December, 1978), pp. 22–31.

The compound represented by the general formula (I) which is capable of releasing a diffusible dye can be preferably employed in heat-developable light-sensitive materials utilizing silver halide in which a mobile dye is formed upon heat development and the dye is transferred to a dye fixing layer as described, for example, in JP-A-58-149046, JP-A-59-154445, JP-A-59-165054, JP-A-59-180548, JP-A-59-218443, JP-A-60-133449, U.S. Pat. Nos. 4,503,137, 4,474,867, 4,483,914, 4,455,363 and 4,500,626, and Japanese Patent Application No. 60-79709. The heat-developable light-sensitive material is hereinafter referred to as a light-sensitive element.

In the case the compound (I) is applied to heat-developable light-sensitive materials, an organic metal salt may be employed as an oxidizing agent together with the light-sensitive silver halide. Among the organic metal salts, organic silver salts are particularly preferred.

Examples of organic compounds which can be used to form the above-described organic silver salt oxidizing agent include benzotriazoles, fatty acids and compounds described in U.S. Pat. No. 4,500,626 (columns 52 and 53). Other examples of useful organic compounds include silver salts of carboxylic acids containing an alkynyl group such as silver phenylpropiolate as described in JP-A-60-113235 and acetylene silver as described in JP-A-61-249044. Two or more organic silver salts may be used in combination.

These organic silver salts may be used in an amount of from 0.01 to 10 mol, preferably from 0.01 to 1 mol, per mol of light-sensitive silver halide. The total amount of light-sensitive silver halide and organic silver salt to be coated is preferably in the range of 50 mg to 10 g/$m^2$ in terms of silver.

As binders of layers for constituting the light-sensitive element and dye fixing element, hydrophilic binders are preferably employed. Examples of such binders are described in JP-A-62-253159, pages 26 to 28. More specifically, transparent or translucent hydrophilic binders are preferred. Suitable examples of such binders include natural substances such as proteins (for example, gelatin and gelatin derivatives) and polysaccharides (for example, cellulose derivatives, starch, gum arabic, dextrin and pullulan), and synthetic polymer compounds (for example, polyvinyl alcohol, polyvinyl pyrrolidone and acrylamide polymers).

Further, highly water absorptive polymers such as homopolymers of vinyl monomer containing —COOM or —$SO_3M$ (M represents a hydrogen atom or an alkali metal) or copolymers comprising two or more of such vinyl monomers or comprising such a vinyl monomer and another vinyl monomer (for example, sodium methacrylate, ammonium methacrylate and Sumicagel L-5H manufactured by Sumitomo Chemical Co., Ltd.) as described, for example, in JP-A62-245260.

Two or more of these binders may be employed in combination.

When a system of conducting heat development together with supplying a slight amount of water is adopted, it becomes possible to absorb water rapidly using the above-described highly water absorptive polymer. Further, re-transfer of dyes from a dye fixing element to other materials after dye transfer is prevented by incorporating the highly water absorptive polymer into a dye fixing layer or a protective layer thereof.

In the present invention, the amount of the binder to be coated is preferably 20 g or less, more preferably 10 g or less, particularly preferably 7 g or less, per square meter.

Various polymer latexes can be incorporated into layers constituting the light-sensitive element or image fixing element (including a back layer), for the purpose of improving physical properties of layers, i.e., increasing dimensional stability, preventing curling, blocking, cracking, and pressure sensitization or desensitization. Specifically, any of the polymer latexes as described, for example, in JP-A-62-245258, JP-A-62-136648 and JP-A-62-110066 may be employed. In particular, the cracking of a mordanting layer can be prevented using a polymer latex having a low glass transition point (40° C. or less) in the mordanting layer, and the curling can be effectively prevented by adding a polymer latex having a high glass transition point to the back layer.

The reducing agents which can be used in the present invention are those known in the field of heat-developable light-sensitive materials. Also, there may be employed dye providing compounds having a reducing power as described hereinafter. In the latter case, other reducing agents may be employed together therewith. Furthermore, as such reducing agents there can be used precursors of reducing agents which have no reducing power themselves but take on reducing power when acted on by nucleophilic reagents or heat during development.

Examples of reducing agents which can be used in the present invention include reducing agents and precursors thereof as described, for example, in U.S. Pat. Nos. 4,500,626 (columns 49 to 50), 4,483,914 (columns 30 to 31), 4,330,617 and 4,590,152, JP-A-60-140335 (pages 17 and 18), JP-A-57-40245, JP-A-56-138736, JP-A-59-178458, JP-A-59-53831, JP-A-59-182449, JP-A-59-182450, JP-A-60-119555, JP-A-60-128436, JP-A-60-128437, JP-A-60128438, JP-A-60-128439, JP-A-60-198540, JP-A-60-181742, JP-A-61-259253, JP-A-62-244044, JP-A-62-131253, JP-A-62131254, JP-A-62-131255, JP-A-62-131256, and European Patent No. 220,746 A2 (pages 78 to 96).

Combinations of various reducing agents as disclosed in U.S. Pat. No. 3,039,869 may be used in the present invention.

In case of using a diffusion resistant reducing agent, an electron transfer agent and/or a precursor thereof can be employed in combination, if desired, in order to accelerate transfer of electron between the diffusion resistant reducing agent and developable silver halide. Suitable electron transfer agents or precursors thereof can be selected from the reducing agents or precursors thereof described above. It is desired that the mobility of the electron transfer agent or precursor thereof is larger than that of the diffusion resistant reducing agent (electron donor). Particularly useful electron transfer agents are 1-phenyl-3-pyrazolidones and aminophenols.

The diffusion resistant reducing agents (electron donors) which can be used together with the electron transfer agent may be any one of the above-described reducing agents which is substantially immobile in the layers of the light-sensitive element. Hydroquinones, sulfonamidophenols, sulfonamidonaphthols, electron donor compounds as described in JP-A-53-110827 or diffusion resistant dye providing compounds having a reducing power as described hereinafter are preferably employed.

In the present invention, the added amount of the reducing agent is preferably from 0.01 to 20 mols, particularly preferably from 0.1 to 10 mols, per mol of silver.

In the present invention, the light-sensitive element may contain a compound which serves to activate development as well as to stabilize images. Specific examples of such compounds which can be preferably used in the present invention are described in U.S. Pat. No. 4,500,626 (column 51 to 52).

In a system which employs a dye diffusion transfer to form images, a dye fixing element is used together with a light-sensitive element. A light-sensitive element and a dye fixing element can be separately coated on two supports, or a light-sensitive element and a dye fixing element can be coated on the same support.

For the relationship between the light-sensitive element and the dye fixing element, between the light-sensitive element and the support, and between the light-sensitive element and the white reflecting layer, those as described in U.S. Pat. No. 4,500,626 (column 57) can be applied to the present invention.

The dye fixing element which may be preferably used in the present invention comprises at least one layer containing a mordant and a binder. Mordants which can be used in the present invention include those known in the field of photography, and specific examples thereof are mordants as described,,for example, in U.S. Pat. No. 4,500,626 (columns 58 to 59), JP-A-61-88256 (pages 32 to 41), JP-A-62-244043 and JP-A-62-244036. Further, dye receptive polymer compounds as described in U.S. Pat. No. 4,463,079 may be employed.

The dye fixing element may comprise a subsidiary layer, for example, a protective layer, a stripping layer and an anti-curling layer, if desired. Particularly, it is effective to provide a protective layer.

To the layers constituting the light-sensitive element and dye fixing element, plasticizers, slipping agents, and organic solvents having a high boiling point as agents for improving the stripping property of the light-sensitive element and dye fixing element can be added thereto. Specific examples thereof are those as described, for example, in JP-A-62-253159 (page 25) and JP-A-62-245253.

Moreover, for the purpose described above, various silicone oils (for example, dimethyl silicone oil and modified silicone oils obtained by introducing various organic groups to dimethylsiloxane) can be employed. Preferred examples of the silicone oils are various modified silicone oils, particularly carboxy-modified silicone (trade name: X-22-3710) as described in *Modified Silicone Oil,* technical data, pages 6 to 18B published by Shinetsu Silicone Co. Silicone oils described in JP-A-62-215953 and Japanese Patent Application No. 62-23687 are also effective.

In the light-sensitive element and dye fixing element, color fading preventing agents may be employed. Color fading preventing agents include antioxidants, ultraviolet light absorbing agents and certain kinds of metal complexes.

Suitable examples of antioxidants include chroman series compounds, coumaran series compounds, phenol series compounds (for example, hindered phenols), hydroquinone derivatives, hindered amine derivatives and spiroindan series compounds. Further, compounds as described in JP-A-61-159644 are also effective.

Suitable examples of ultraviolet light absorbing agents include benzotriazole series compounds (those as described in U.S. Pat. No. 3,533,794), 4-thiazolidone series compounds (those as described in U.S. Pat. No. 3,352,681), benzophenone series compounds (those as described in JP-A-46-2784), and compounds as described in JP-A-54-48535, JP-A-62-136641 and JP-A-61-88256. Further, ultraviolet light absorptive polymers as described in JP-A-62-260152 are effective.

Suitable examples of metal complexes include compounds as described in, for example, U.S. Pat. Nos. 4,241,155, 4,245,018 (columns 3 to 36), and 4,254,195 (columns 3 to 8), JP-A-62-174741, JP-A-61-88256 (pages 27 to 29), and Japanese Pat. No. Application Nos. 62-234103, 62-31096 and 62-230596.

Suitable examples of color fading preventing agents are described in JP-A-62-215272 (pages 125 to 137).

Color fading preventing agents for the purpose of preventing fading of transferred dyes in the dye fixing element can be previously incorporated into the dye fixing element or may be supplied to the dye fixing element from the outside, for example, from the light-sensitive element.

The above-described antioxidants, ultraviolet light absorbing agents and metal complexes may be used in combination.

In the light-sensitive element and dye fixing element, there may be used fluorescent whitening agents. It is particularly preferred to incorporate fluorescent whitening agents into the dye fixing element or to supply them from the outside, for example, from the light-sensitive element. Suitable examples of fluorescent whitening agents are described, for example, in K. Veenkataraman, *The Chemistry of Synthetic Dyes,* Vol. V, Chapter 8 and JP-A-61-143752. More specifically, preferred fluorescent whitening agents include stilbene series compounds, coumarin series compounds, biphenyl series compounds, benzoxazole series compounds, phthalimide series compounds, pyrazoline series compounds and carbostyryl series compounds.

The fluorescent whitening agents may be employed in combination with the color fading preventing agents.

Suitable examples of hardening agents used in the layers constituting the light-sensitive element and dye fixing element include those as described in U.S. Pat. No. 4,678,739 (column 41), JP-A-59-116655, JP-A-62-245261 and JP-A-61-18942. More specifically, aldehyde series hardeners (for example, formaldehyde), aziridine series hardeners, epoxy series hardeners (for example,

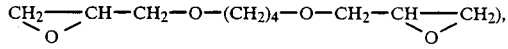

vinylsulfone series hardeners (for example, N,N,-ethylenebis(vinylsulfonylacetamido)ethane), N-methylol series hardeners (for example, dimethylolurea), and polymer hardeners (for example, compounds as described in JP-A-62-234157.

To the layers comprising the light-sensitive element and dye fixing element, various surface active agents can be added as coating aids or for other purposes, for example, improvement in stripping property, improvement in sliding property, antistatic property, and development acceleration. Specific examples of useful surface active agents are described in JP-A-62-173463 and JP-A-62-183457.

Organic fluoro compounds may be incorporated into the layers constituting the light-sensitive element and dye fixing element, for the purpose of improvement in sliding property, antistatic property, and improvement in stripping property. Typical examples of the organic fluoro compounds include fluorine series surface active agents as described in JP-B-57-9053 (columns 8 to 17), JP-A-61-20944 and JP-A-62-135826, oily fluorine series compounds such as fluoro oil, and hydrophobic fluorine compounds such as solid fluoro resin compound, for example, tetrafluoroethylene resin.

In the light-sensitive element and dye fixing element, matting agents can be used. Suitable examples of matting agents include silicon dioxide, compounds such as polyolefin and polymethacrylate as described in JP-A61-88256, page 29, as well as benzoguanamine resin beads, polycarbonate resin beads and AS resin beads as described in Japanese Patent Application Nos. 62-110064 and 62-110065.

Furthermore, other additives, for example, heat solvents, defoaming agents, sterilizers, antimolds, and colloidal silica may be incorporated into the layers constituting the light-sensitive element and dye fixing element. Specific examples of these additives used are described in JP-A-61-88256, pages 26 to 32.

In the light-sensitive element and/or dye fixing element according to the present invention, image formation accelerating agents can be employed. Such image formation accelerating agents serve to accelerate an oxidation reduction reaction of a silver salt oxidizing agent with a reducing agent, a reaction such as the formation or decomposition of a dye or release of a diffusible dye from a dye providing substance, and migration of a dye from a light-sensitive material layer to a dye fixing layer. In view of physicochemical function, image formation accelerating agents can be classified into bases or base precursors, nucleophilic compounds, organic solvents having a high boiling point (oils), heat solvents, surface active agents, and compounds capable of interacting with silver or silver ion. However, these substance groups generally have a composite function and thus a combination of the above-described accelerating effects. The details thereof are described in U.S. Pat. No. 4,678,739 (columns 38 to 40)

Examples of useful base precursors include salts of organic acids and base which decompose by heating with decarboxylation, and compounds which release an amine upon decomposition with an intramolecular nucleophilic displacement reaction, a Lossen rearrangement reaction or a Beckmann rearrangement reaction. Specific examples thereof are described, for example, in U.S. Pat. No. 4,511,493 and JP-A-62-65038.

In a system wherein heat development and transfer of dye are simultaneously conducted in the presence of a small amount of water, it is preferred to incorporate a base and/or a base precursor into the dye fixing element from the standpoint of increasing preservability of the light-sensitive material.

In addition, combinations of sparingly soluble metal compounds and compounds (referred to as complex forming compounds) capable of forming a complex with a metal ion constituting the sparingly soluble metal compound as described in European Patent Application (OPI) No. 210,660, and compounds which generate a base upon electrolysis as described in JP-A-61-232451 can be employed as base precursors. Particularly, the former method is effective. It is advantageous that the sparingly soluble metal compound and the complex forming compound are added separately to the light-sensitive element and the dye fixing element.

In the light-sensitive element and/or dye fixing element, various development stopping agents can be used for the purpose of providing a constant image against any fluctuation in processing temperature and time during development.

The term "development stopping agent" as used herein means a compound which rapidly neutralizes or reacts with a base to decrease the base concentration in the layer so that development is stopped after proper development, or a compound which interacts with silver or silver salt to inhibit development after proper development. Specific examples of such development stopping agents include acid precursors which release an acid upon heating, electrophilic compounds which undergo a displacement reaction with a base present therewith upon heating, nitrogen-containing heterocyclic compounds, mercapto compounds and precursors thereof. More specifically, those described in JP-A-62-253159 (pages 31 and 32) are employed.

Supports used in the light-sensitive element and dye fixing element according to the present invention are those which can endure the processing temperature. In general, paper and synthetic polymer films are employed. More specifically, films of polyethylene terephthalate, polycarbonate, polyvinyl chloride, polystyrene, polypropylene, polyimide and celluloses (for example, triacetyl cellulose) or those film containing pigment such as titanium oxide, synthetic paper produced from polypropylene, paper manufactured from a mixture of synthetic pulp such as polyethylene and natural pulp, Yankee paper, baryta paper, coated paper (particularly cast coating paper), metals, cloths, and glass are employed. These may be employed individually or as supports one or both surfaces of which can be laminated with synthetic polymers such as polyethylene. Further, supports as described in JP-A-62-253159 (pages 21 to 31) are usable.

On the surface of the support, a mixture of a hydrophilic binder and a semiconductive metal oxide such as alumina sol and tin oxide, and an antistatic agent such as carbon black may be coated.

In order to expose image for recording on the light-sensitive material, various methods can be utilized, for example, a method of direct photographing a landscape or portrait using a camera, a method of exposure through a reversal film or a negative film by means of a printer or an enlarger, a method of scanning exposure of an original through a slit using an exposure device of a copying machine, a method wherein image information is exposed upon light emission from a light emitting diode or various laser via electric signal, and a method wherein image information on an image display device, for example, CRT, liquid crystal display, electroluminescence display, or plasma display is exposed directly or through an optical system.

Light sources for recording image on the light-sensitive element which can be used include those as described in U.S. Pat. No. 4,500,626 (column 50) such as natural light, tungsten lamps, light emitting diodes, laser light sources, and CRT light sources.

Moreover, the above-described image informations used include image signals obtained by a video camera or an electro still camera, television signals represented by Japan Television Signal Standard (NTSC), image signals obtained by dividing an original into many dots by means of a scanner, and image signals prepared by means of a computer represented by CG and CAD.

In accordance with the present invention, color photographic light-sensitive materials which provide high image density in a rapid and simple manner are obtained by incorporating the image forming compound represented by the general formula (I) described above. Further, color photographic light-sensitive materials which provide images of excellent color reproducibility are obtained according to the present invention.

The present invention will be explained in greater detail with reference to the following examples, but the present invention should not be construed as being limited thereto.

EXAMPLE 1

A process for the preparation of silver halide emulsion for the first layer is described hereinafter.

600 ml of an aqueous solution containing sodium chloride and potassium bromide and an aqueous solution of silver nitrate which had been prepared by dissolving 0.59 mol of silver nitrate in 600 ml of water were simultaneously added to an aqueous solution of gelatin which had been prepared by dissolving 20 g of gelatin and 3 g of sodium chloride in 1,000 ml of water and kept at a temperature of 75° C at the same flow rate over a period of 40 minutes while the latter was being vigorously stirred. Thus, a monodispersed cubic silver chloro bromide emulsion (bromide content: 50 mol %) having an average particle size of 0.35 μm was prepared.

After being washed with water and desalted, the emulsion was chemically sensitized with 5 mg of sodium thiosulfate and 20 mg of 4-hydroxy-6-methyl-1,3,3a,7-tetraazaindene at a temperature of 60° C. The yield of the emulsion was 600 g.

A process for the preparation of a silver halide emulsion for the third layer is described hereinafter.

600 ml of an aqueous solution containing sodium chloride and potassium bromide, an aqueous solution of silver nitrate which had been prepared by dissolving 0.59 mol of silver nitrate in 600 ml of water and Dye Solution (I) described below were simultaneously added to an aqueous solution of gelatin which had been prepared by dissolving 20 g of gelatin and 3 g of sodium chloride in 1,000 ml of water and kept at a temperature of 75° C at the same flow rate over a period of 40 minutes while the latter was being stirred vigorously. Thus, a monodispersed cubic silver chlorobromide emulsion adsorbed with dye (bromide content: 80 mol %) having an average particle size of 0.35 μm was prepared.

After being washed with water and desalted, the emulsion was chemically sensitized with 5 mg of sodium thiosulfate and 20 mg of 4-hydroxy-6-methyl-1,3,3a,7-tetraazaindene at a temperature of 60° C. The yield of the emulsion was 600 g.

Dye Solution (I):

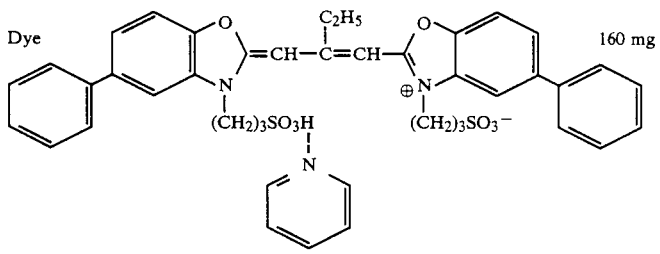

Methanol 400 ml

A process for the preparation of a silver halide emulsion for the fifth layer is described hereinafter.

1,000 ml of an aqueous solution containing potassium iodide and potassium bromide and an aqueous solution of silver nitrate which had been prepared by dissolving 1 mol of silver nitrate in 1,000 ml of water were simultaneously added to an aqueous solution of gelatin which had been prepared by dissolving 20 g of gelatin and ammonia in 1,000 ml of water and kept at a temperature of 75° C. with maintaining pAg at the constant value while the latter was being stirred vigorously. Thus, a monodispersed octahedral silver iodobromide emulsion (iodide content: 5 mol %) having an average particle size of 0.5 μm was prepared.

After being washed with water and desalted, the emulsion was gold and sulfur sensitized with 5 mg of chloroauric acid (tetrahydrate) and 2 mg of sodium thiosulfate at a temperature of 60° C. The yield of the emulsion was 1.0 kg.

Process for the preparation of organic silver salts is described below.

Organic Silver Salt (1)

A process for the preparation of a benzotriazole silver emulsion is described hereinafter.

28 g of gelatin and 13.2 g of benzotriazole were dissolved in 300 ml of water. The solution was then stirred with the temperature kept at 40° C. A solution of 17 g of silver nitrate dissolved in 100 ml of water was added to the solution over a period of 2 minutes.

The pH of the benzotriazole silver emulsion was properly adjusted to flocculate. The excess salts were then removed. The pH of the emulsion was then adjusted to 6.30 to obtain 400 g of the benzotriazole silver emulsion.

Organic Silver Salt (2)

A process for the preparation of a dispersion of Organic Silver Salt (2) is described hereinafter.

20 g of gelatin and 5.9 g of 4-acetylaminophenyl propiolic acid were dissolved in 1,000 ml of a 0.1% aqueous sodium hydroxide solution and 200 ml of ethanol. The solution thus prepared was then stirred with the temperature thereof kept at 40° C. A solution of 4.5 g of silver nitrate dissolved in 200 ml of water was added to the solution for 5 minutes. The pH of the dispersion thus prepared was properly adjusted to flocculate. The excess salts were then removed. The pH of the dispersion was adjusted to 6.3 to obtain 300 g of the dispersion of Organic Silver Salt (2).

A process for the preparation of a gelatin dispersion of an image forming compound is described hereinafter.

A mixture of 5 g of Image Forming Compound (1) according to the present invention, 0.2 g of an anti-fogging agent described below, 2.5 g of triisononyl phosphate and 30 ml of ethyl acetate was dissolved by heating at about 60° C to prepare a uniform solution. This solution was mixed with 100 g of a 10% aqueous solution of lime-processed gelatin containing 0.5 g of sodium dodecylbenzenesulfonate with stirring, and the mixture was then dispersed by means of a homogenizer at 10,000 rpm for 10 minutes. The dispersion thus obtained was designated a dispersion of magenta image forming compound.

Antifogging Agent:

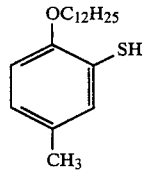

In the same manner as described above, dispersons of image forming compounds were prepared using a yellow image forming compound and a cyan image forming compound as described below, respectively.

Yellow Image Forming Compound:

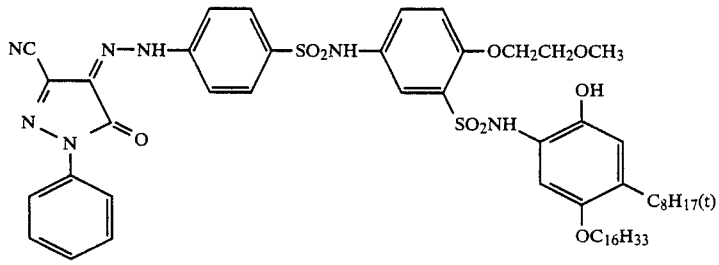

Cyan Image Forming Compound:

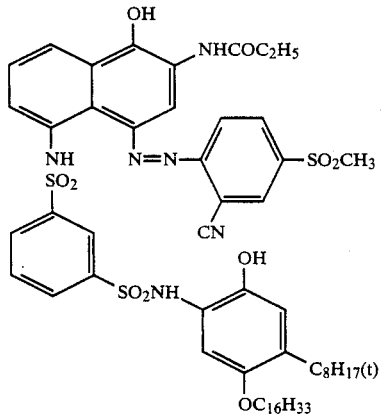

These materials were used to prepare Multilayer Color Photographic Light-Sensitive Material 101 as shown in Table 1 below.

TABLE 1

Sixth Layer:
Gelatin (coated amount: 800 mg/m$^2$)

TABLE 1-continued

Hardening agent*6 (coated amount: 100 mg/m$^2$)
Silica*5 (coated amount: 100 mg/m$^2$)
Zinc hydroxide*7 (coated amount: 300 mg/m$^2$)

Fifth Layer: Blue-Sensitive Emulsion Layer
Silver iodobromide emulsion (iodide: 5 mol %, coated amount: 400 silver/m$^2$)
Dimethyl sulfamide (coated amount: 180 mg/m$^2$)
Organic Silver Salt (2) (coated amount: 100 mg silver/m$^2$)
Yellow image forming compound (coated amount: 400 mg/m$^2$)
Gelatin (coated amount: 1,000 mg/m$^2$)
Solvent having a high boiling point*4 (coated amount: 200 mg/m$^2$)
Surface active agent (coated amount: 100 mg/m$^2$)
Antifogging agent (coated amount: 16 mg/m$^2$)

Fourth Layer: Intermediate Layer
Gelatin (coated amount: 1,000 mg/m$^2$)
Zinc hydroxide*7 (coated amount: 300 mg/m$^2$)

Third Layer: Green-Sensitive Emulsion Layer
Silver chlorobromide emulsion (bromide: 80 mol %, coated amount: 300 mg silver/m$^2$)
Dimethyl sulfamide (coated amount: 180 mg/m$^2$)
Organic Silver Salt (2) (coated amount: 100 mg silver/m$^2$)
Magenta Image Forming Compound (1) (coated amount: 400 mg/m$^2$)
Gelatin (coated amount: 1,000 mg/m$^2$)
Organic solvent having a high boiling point*4 (coated amount: 200 mg/m$^2$)
Surface active agent*2 (coated amount: 100 mg/m$^2$)
Antifogging agent (coated amount: 16 mg/m$^2$)

Second Layer: Intermediate Layer
Gelatin (coated amount: 800 mg/m$^2$)
Zinc hydroxide*7 (coated amount: 300 mg/m$^2$)

First Layer: Red-Sensitive Emulsion Layer
Silver chlorobromide emulsion (bromide: 80 mol %, coated amount: 300 mg silver/m$^2$)
Benzenesulfonamide (coated amount: 180 mg/m$^2$)
Organic Silver Salt (1) (coated amount: 100 mg silver/m$^2$)
Sensitizing dye*3 (coated amount: $8 \times 10^{-7}$ mol/m$^2$)
Cyan image forming compound (coated amount: 100 mg/m$^2$)
Gelatin (coated amount: 1,000 mg/m$^2$)
Organic solvent having a high boiling point*4 (coated amount: 150 mg/m$^2$)
Surface active agent*2 (coated amount: 100 mg/m$^2$)
Antifogging agent (coated amount: 12 mg/m$^2$)

TABLE 1-continued

Support*1

*1Polyethylene terephthalate (100 μm thick)

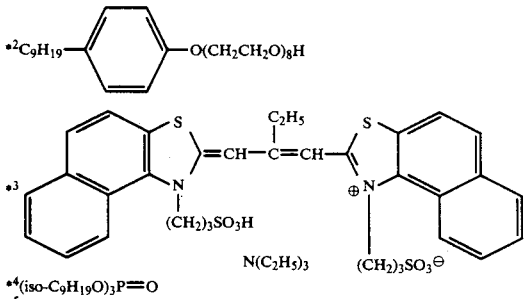

*4(iso-$C_9H_{19}O)_3P{=}O$
*5 4 μm size
*6 1,2-Bis(vinylsulfonylacetamido)ethane
*7 0.2 μm size A process for the preparation of a dye fixing element is described hereinafter.

63 g of gelatin, 130 g of a mordant shown below and 80 g of guanidine picrate were dissolved in 1,300 ml of water and the solution was coated at a wet layer thickness of 45 μm on a paper support laminated with polyethylene and dried.

Mordant

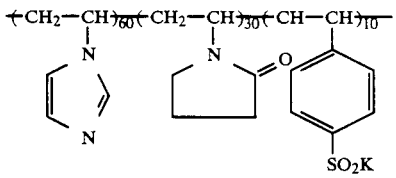

On the layer thus-coated, an aqueous solution prepared by dissolving 35 g of gelatin and 1.05 g of 1,2-bis(vinylsulfonylacetamido)ethane in 800 ml of water was coated at a wet layer thickness of 17 μm and dried to prepare Dye Fixing Material D-1.

The multilayer color photographic light-sensitive material as described above was exposed to light through a three color separation filter of B, G and R, the density of which continuously changes, for 1 second at 2,000 lux using a tungsten lamp. On the emulsion side surface of the exposed light-sensitive material was supplied water at a rate of 15 ml/$m^2$ by a wire bar and then it was superimposed on the dye fixing material in such a manner that their coated layers were in contact with each other. These materials were heated for 2 seconds using a heat roller which had been adjusted such that the temperature of water absorbed by the layers become 95° C.

Then, the dye fixing material was peeled apart from the light-sensitive material, whereupon clear yellow, magenta and cyan images were obtained in the dye fixing material corresponding to the three color separation filter of B, G and R, respectively.

The maximum density (Dmax) and the minimum density (Dmin) of each color were measured.

The results thus-obtained are shown in Table 2.

TABLE 2

| | Dmax | Dmin |
|---|---|---|
| Yellow | 1.90 | 0.12 |
| Magenta | 2.24 | 0.14 |
| Cyan | 2.10 | 0.14 |

From the results shown in Table 2, it is apparent that the maximum density of magenta image is high.

EXAMPLE 2

Multilayer Color Photographic Light-Sensitive Materials 201 and 202 were prepared in the same manner as described in Example 1, except using Compound (x) and Compound (y) described below in place of compound (1) according to the present invention used in Example 1 as the magenta image forming compound, respectively.

Magenta Image Forming Compound (x)

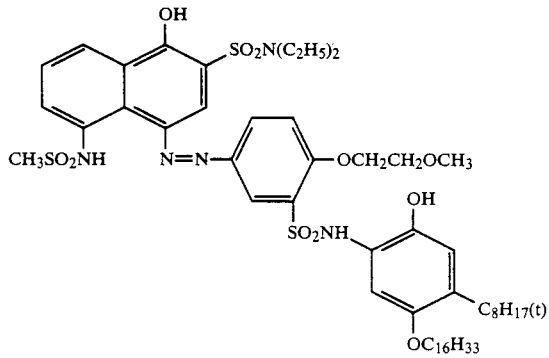

Magenta Image Forming Compound (y)

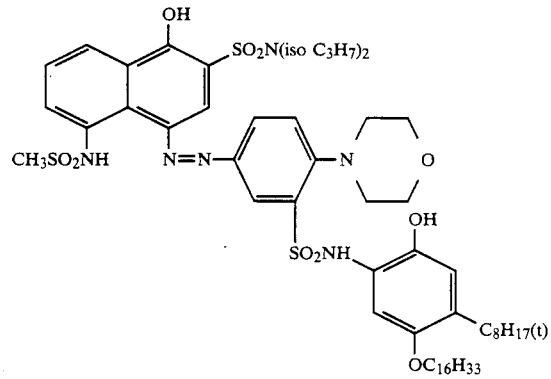

The preparation of a dye fixing material, exposure to light and development processing were conducted in the same manner as described in Example 1.

Upon peeling apart the dye fixing material from the light-sensitive material, clear yellow, magenta and cyan images were obtained in the dye fixing material corresponding to the three color separation filter of B, G and R, respectively.

The maximum density (Dmax) and the minimum density (Dmin) with respect to magenta color images obtained from Light-Sensitive Materials 201 and 202 were measured. The results are compared with those of Light-Sensitive Material 101 as shown in Table 3.

TABLE 3

| Light-Sensitive Material | Magenta Image Forming Compound | Dmax | Dmin |
|---|---|---|---|
| 101 | (1) (Invention) | 2.24 | 0.14 |
| 201 | (x) (Comparison) | 1.95 | 0.14 |

TABLE 3-continued

| Light-Sensitive Material | Magenta Image Forming Compound | Dmax | Dmin |
|---|---|---|---|
| 202 | (y) (Comparison) | 1.48 | 0.12 |

From the results shown in Table 3, it can be seen that the compound according to the present invention provides a high image density.

Figure 2:
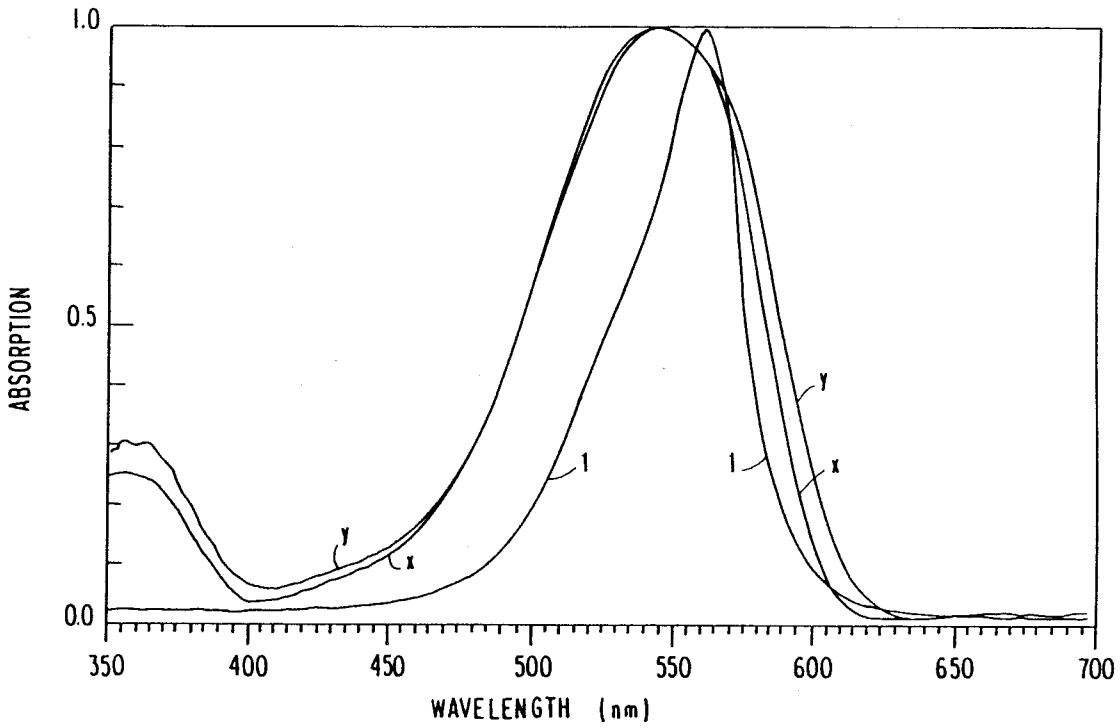

Further, the absorption spectra of the transferred images (transferred images are a transparent film having a mordanting layer) were measured. The results are shown in FIG. 2. It can be seen that the compound according to the present invention exhibits excellent spectral characteristics. The λmax of (1), (x) and (y) were 561.9 nm, 544.9 nm and 545 nm, respectively.

EXAMPLE 3

The process for the preparation of silver halide emulsions for the fifth layer and the first layer is described hereinafter.

600 ml of an aqueous solution containing sodium chloride and potassium bromide and an aqueous solution of silver nitrate which had been prepared by dissolving 0.59 mol of silver nitrate in 600 ml of water were simultaneously added to an aqueous solution of gelatin which had been prepared by dissolving 20 g of gelatin and 3 g of sodium chloride in 1,000 ml of water and kept at a temperature of 75° C at the same flow rate over a period of 40 minutes while the latter was being vigorously stirred. Thus, a monodispersed cubic silver chlorobromide emulsion (bromide content: 50 mol %) having an average particle size of 0.40 μm was prepared.

After being washed with water and desalted, the emulsion was chemically sensitized with 5 mg of sodium thiosulfate and 20 mg of 4-hydroxy-6-methyl-1,3,3a,7-tetraazaindene at a temperature of 60° C. The yield of the emulsion was 600 g.

A process for the preparation of a silver halide emulsion for the third layer is described hereinafter.

600 ml of an aqueous solution containing sodium chloride and potassium bromide and an aqueous solution of silver nitrate which had been prepared by dissolving 0.59 mol of silver nitrate in 600 ml of water were simultaneously added to an aqueous solution of gelatin which had been prepared by dissolving 20 g of gelatin and 3 g of sodium chloride in 1,000 ml of water and kept at a temperature of 75° C at the same flow rate over a period of 40 minutes while the latter was being stirred vigorously. Thus, a monodispersed cubic silver chlorobromide emulsion (bromide content: 80 mol %) having an average particle size of 0.35 μm was prepared.

After being washed with water and desalted, the emulsion was chemically sensitized with 5 mg of sodium thiosulfate and 20 mg of 4-hydroxy-6-methyl-1,3,3a,7-tetraazaindene at a temperature of 60° C. The yield of the emulsion was 600 g.

A process for the preparation of a gelatin dispersion of an image forming compound is described hereinafter.

A mixture of 5 g of Magenta Image Forming Compound (1) according to the present invention, 0.3 g of the antifogging agent same as described in Example 1, 0.5 g of sodium succinate-2-ethylhexyl ester sulfonate, as a surface active agent, 10 g of triisononyl phosphate and 30 ml of ethyl acetate was dissolved by heating at about 60° C to prepare a uniform solution This solution was mixed with 100 g of a 10% aqueous gelatin solution of lime-processed gelatin and the mixture was then dispersed by means of a homogenizer at 10,000 rpm for 10 minutes. The dispersion thus obtained was designated a dispersion of magenta image forming compound.

Dispersions of yellow and cyan image forming compounds were prepared in the same manner as described above using the yellow and cyan image forming compound as described above, respectively.

Organic Silver Salts (1) and (2) as described in Example 1 were used.

Using these materials, Multilayer Color Photographic Light-Sensitive Material 301 as shown in Table 4 was prepared.

TABLE 4

Sixth Layer:
Gelatin (coated amount: 1,000 mg/m$^2$)
Base precursor*3 (coated amount: 600 mg/m$^2$)
Silica*5 (coated amount: 100 mg/m$^2$)
Hardening agent*6 (coated amount: 160 mg/m$^2$)
Fifth Layer: Green-Sensitive Emulsion Layer
Silver chlorobromide emulsion (bromide content: 50 mol %, coated amount: 400 mg silver/m$^2$)
Benzenesulfonamide (coated amount: 180 mg/m$^2$)
Organic silver salt (1) (coated amount: 50 mg/m$^2$)
Organic silver salt (2) (coated amount: 50 mg/m$^2$)
Sensitizing Dye (D-1) (coated amount: $10^{-6}$ mol/m$^2$)
Base precursor*3 (coated amount: 500 mg/m$^2$)
Antifogging agent (coated amount: 24 mg/m$^2$)
Yellow image forming compound (coated amount: 400 mg/m$^2$)
Gelatin (coated amount: 1,000 mg/m$^2$)
High Boiling solvent*4 (coated amount: 800 mg/m$^2$)
Surface active agent*2 (coated amount: 100 mg/m$^2$)
Fourth Layer: Intermediate Layer
Gelatin (coated amount: 1,200 mg/m$^2$)
Base precursor*3 (coated amount: 600 mg/m$^2$)
Third Layer: Red-Sensitive Emulsion Layer
Silver chlorobromide emulsion (bromide content: 80 mol %, coated amount: 300 mg/m$^2$)
Benzenesulfonamide (coated amount: 180 mg/m$^2$)
Organic silver salt (1) (coated amount: 50 mg/m$^2$)
Organic silver salt (2) (coated amount: 50 mg/m$^2$)
Sensitizing Dye (D-2) ($10^{-7}$ mol/m$^2$)
Base precursor*3 (coated amount: 450 mg/m$^2$)
Antifogging agent (coated amount: 24 mg/m$^2$)
Magenta Image Forming Compound (1) (coated amount: 400 mg/m$^2$)
Gelatin (coated amount: 1,000 mg/m$^2$)
High boiling solvent*1 (coated amount: 600 mg/m$^2$)
Surface active agent*2 (coated amount: 100 mg/m$^2$)
Second Layer: Intermediate Layer
Gelatin (coated amount: 1,000 mg/m$^2$)
Base precursor*3 (coated amount: 600 mg/m$^2$)
First Layer: Infrared-Sensitive Emulsion Layer
Silver chlorobromide emulsion (bromide content: 50 mol %, coated amount: 300 mg silver/m$^2$)
Benzenesulfonamide (coated amount: 180 mg/m$^2$)
Organic Silver Salt (1) (coated amount: 50 mg/m$^2$)
Organic Silver Salt (2) (coated amount: 50 mg/m$^2$)
Sensitizing Dye (D-3) (coated amount: $10^{-8}$ mol/m$^2$)
Base precursor*3 (coated amount: 500 mg/m$^2$)
Antifogging agent (coated amount: 18 mg/m$^2$)
Cyan image forming compound (coated amount: 300 mg/m$^2$)
Gelatin (coated amount: 1,000 mg/m$^2$)
High boiling solvent*4 (coated amount: 600 mg/m$^2$)
Surface active agent*2 (coated amount: 100 mg/m$^2$)
Support*7

*1Tricresyl phosphate

TABLE 4-continued

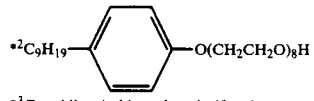

*2 $C_9H_{19}$—C$_6$H$_4$—$O(CH_2CH_2O)_8H$

*3Guanidine 4-chlorophenylsulfonylacetate

*4(iso-$C_9H_{19}O)_3P{=}O$

*5 4 μm size

*6 1,2-Bis(vinylsulfonylacetamido)ethane

*7Polyethylene terephthalate (100 μm thick)

(D-1)

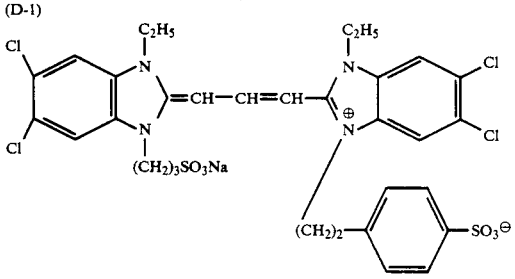

(D-2)

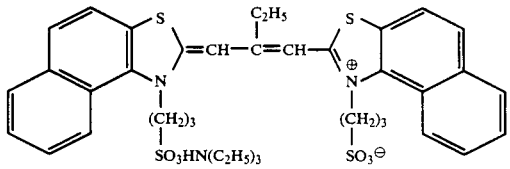

(D-3)

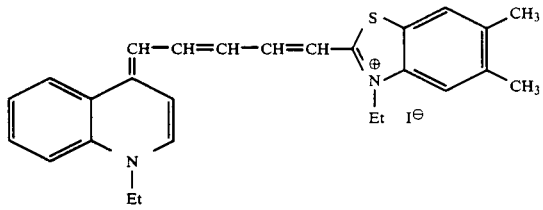

Dye Fixing Material D-2 was prepared in the same manner as described for Dye Fixing Material D-1 used in Example 1 except eliminating guanidine picrate.

The above-described Multilayer Color Photographic Light-Sensitive Material 301 was exposed through a three color separation filter of G, R and IR (G: filter transmitting a band of 500 μm to 600 μm, R: filter transmitting a band of 600 μm to 700 μm, IR: filter transmitting a band of 700 μm or higher), the density of which continuously changes, for 1 second at 500 lux using a tungsten lamp and then uniformly heated for 30 seconds on a heat block which had been heated to 140° C.

To the coated layer of the dye fixing material D-2 was applied 20 ml per $m^2$ of water, and the above-heated light-sensitive material was then superimposed on the dye fixing material in such a manner that their coated layers were in contact with each other.

After heating for 6 seconds on a heat block maintained at 80° C, the dye fixing material was separated from the light-sensitive material, whereupon yellow, magenta and cyan color images were obtained in the dye fixing material corresponding to the three color separation filter of of G, R and IR, respectively.

The maximum density (Dmax) and the minimum density (Dmin) of each color were measured using a Macbeth reflection densitometer (RD-519).

The results thus obtained are shown in Table 5.

TABLE 5

| | Dmax | Dmin |
|---|---|---|
| Yellow | 1.98 | 0.21 |
| Magenta | 2.31 | 0.24 |
| Cyan | 2.17 | 0.25 |

From the results shown in Table 5, it is apparent that the magenta image forming compound according to the present invention provides a high image density.

EXAMPLE 4

In the same manner as described in Example 1, light-sensitive materials were prepared except using Compounds (4), (5) and (7) according to the present invention, respectively, in place of Compound (1) and processed. Almost the same results as those in Example 1 were obtained.

While the invention has been described in detail and with reference to specific embodiments thereof, it will be apparent to one skilled in the art that various changes and modifications can be made therein without departing from the spirit and scope thereof.

What is claimed is:

1. A color photographic light-sensitive material comprising a support having thereon at least one layer containing a light-sensitive silver salt, wherein said color photographic light-sensitive material contains at least one image forming compound represented by the following general formula (I):

$$(\text{Dye}—X)_q—Y \qquad (I)$$

wherein Dye represents a magenta dye moiety or a precursor thereof represented by the general formula (II); X represents a chemical bond or a connecting group; Y represents a group which has a property of cleaving the X—Y bond upon a development reaction in correspondence or counter-correspondence to light-sensitive silver salts having a latent image distributed imagewise; and q represents 1 or 2, further provided that when q represents 2, two Dye-X's may be the same or different;

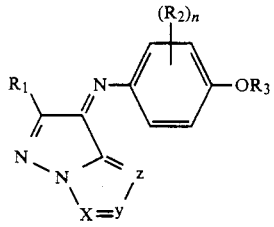

(II)

wherein $R_1$ and $R_2$, which may be the same or different, each represents a hydrogen atom, a halogen atom, an alkyl group, a cycloalkyl group, an aralkyl group, an alkenyl group, an aryl group, an alkoxy group, an aryloxy group, a cyano group, an acylamino group, a sulfonylamino group, a ureido group, an alkylthio group, an arylthio group, an alkoxycarbonyl group, a carbamoyl group, a sulfamoyl group, a sulfonyl group, an acyl group, a urethane group, an amino group, a hydroxyl group, a carboxyl group, a sulfamoylamino group or a heterocyclic group; n represents an integer of from 0 to 3; and when n represents 2 to 3, two or three $R_2$'s may be the same or different, or two $R_2$'s may combine with each other to form a saturated or unsaturated ring; x and z represent a nitrogen atom, y represents

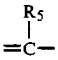

$R_4$ represents a hydrogen atom, an alkyl group, a cycloalkyl group, an aralkyl group, an aryl group, an alkoxy group, an aryloxy group, an amino group, an acylamino group or a sulfonylamino group; $R_3$ represents a hydrogen atom, a monovalent cation or a hydrolyzable group; Dye is connected to X at $R_1$, $R_2$, $R_3$, x, y, or z in the general formula (II);

and further provided that the above-described substituents may be further substituted with other substituents.

2. A color photographic light-sensitive material as claimed in claim 1, wherein $R_1$ represents an alkyl group having up to 6 carbon atoms, an alkoxy group having up to 6 carbon atoms, a chlorine atom, an acylamino group having up to 7 carbon atoms, a sulfonylamino group having up to 7 carbon atoms, an aryloxy group having up to 8 carbon atoms, a hydroxyl group, a carbonyl group, a carbamoyl group having up to 7 carbon atoms, or a sulfamoyl group having up to 7 carbon atoms.

3. A color photographic light-sensitive material as claimed in claim 1, wherein R2 represents an alkyl group having up to 6 carbon atoms, an alkoxy group having up to 6 carbon atoms, a chlorine atom, an acylamino group having up to 7 carbon atoms, a sulfonylamino group having up to 7 carbon atoms, an aryloxy group having up to 8 carbon atoms, a hydroxyl group, a carbonyl group, a carbamoyl group having up to 7 carbon atoms, or a sulfamoyl group having up to 7 carbon atoms.

4. A color photographic light-sensitive material as claimed in claim 1, wherein $R_3$ represents a hydrogen atom.

5. A color photographic light-sensitive material as claimed in claim 1, wherein X is a group represented by $$-\overset{\overset{R_5}{|}}{N}-$$

wherein $R_5$ represents a hydrogen atom, an alkyl group or a substituted alkyl group, $-SO_2-$, $-CO-$, an alkylene group, a substituted alkylene group, a phenylene group, a substituted phenylene group, a naphthylene group, a substituted naphthylene group, $-O-$, $-SO-$, or a group derived from the combination of two or more of the foregoing groups.

6. A color photographic light-sensitve material as claimed in claim 1, wherein X is a group represented by $$-\overset{\overset{R_5}{|}}{N}-SO_2-, \quad -\overset{\overset{R_5}{|}}{N}-CO-$$

or $-R_6-(L)_k-(R_7)l-$ wherein $R_5$ represents a hydrogen atom, an alkyl group or a substituted alkyl group, $-SO_2-$, $-CO-$, an alkylene group, a substituted alkylene group, a phenylene group, a substituted phenylene group, a naphthylene group, a substituted naphthylene group, $-O-$, $-SO-$, or a group derived from the combination of two or more of the foregoing groups, $R_6$ and $R_7$, which may be the same or different, each represents an alkylene group, a substituted alkylene group, a phenylene group, a substituted phenylene group, a naphthylene group, or a substituted naphthylene group; L represents $-O-$, $-CO-$, $-SO-$, $-SO_2-$, $-SO_2NH-$, $-NHSO_2-$, $-CONH-$ or $-NHCO-$; k represents 0 or 1; and l represents 1 when k is 1, or l represents 1 or 0 when k is 0.

7. A color photographic light-sensitive material as claimed in claim 1, wherein said light-sensitive material further comprises a reducing substance.

8. A color photographic light-sensitive material as claimed in claim 10, wherein said reducing substance is a hydroquinone compound, a 3-pyrazolidone compound, an aminophenol compound, a catechol compound, a p-phenylenediamine compound or an aminonaphthol compound.

* * * * *